US007094064B2

(12) United States Patent
Sweetland et al.

(10) Patent No.: US 7,094,064 B2
(45) Date of Patent: Aug. 22, 2006

(54) MULTIPLE-CONTACT WOVEN ELECTRICAL SWITCHES

(75) Inventors: Matthew Sweetland, Bedford, MA (US); James Moran, Somerville, MA (US); Nam P. Suh, Sudbury, MA (US)

(73) Assignee: Tribotek, Inc., Burlington, MA (US)

( * ) Notice: Subject to any disclaimer, the term of this patent is extended or adjusted under 35 U.S.C. 154(b) by 0 days.

(21) Appl. No.: 10/889,542

(22) Filed: Jul. 12, 2004

(65) Prior Publication Data

US 2005/0045461 A1 Mar. 3, 2005

Related U.S. Application Data

(60) Provisional application No. 60/486,363, filed on Jul. 11, 2003.

(51) Int. Cl.
*H01R 12/00* (2006.01)

(52) U.S. Cl. ..... 439/66; 200/275

(58) Field of Classification Search ..... 439/66–67, 439/405, 775, 493; 200/275
See application file for complete search history.

(56) References Cited

U.S. PATENT DOCUMENTS

| | | | | |
|---|---|---|---|---|
| 1,012,030 | A | 12/1911 | Underwood | 428/107 |
| 2,904,771 | A | 9/1959 | Burtt et al. | |
| 3,197,555 | A | 7/1965 | Mittler | 174/268 |
| 3,257,500 | A | 6/1966 | Rusch et al. | 174/116 |
| 3,371,250 | A | 2/1968 | Ross et al. | 361/809 |
| 3,447,120 | A | 5/1969 | Rack et al. | |
| 3,476,870 | A | 11/1969 | Ross | |
| 3,495,025 | A | 2/1970 | Ross | 174/70 R |
| 3,631,298 | A | 12/1971 | Davis | 361/809 |
| 3,639,978 | A | 2/1972 | Schuman | 29/837 |
| 3,654,381 | A | 4/1972 | Copp | 174/117 F |
| 3,676,923 | A | 7/1972 | Reimer | 29/604 |
| 3,702,895 | A | 11/1972 | De Sio | 174/19 |
| 3,711,627 | A | 1/1973 | Maringulov | 174/255 |
| 3,909,508 | A | 9/1975 | Ross | 174/117 M |
| 3,927,284 | A | 12/1975 | Anderson | 200/5 R |
| 4,082,423 | A | 4/1978 | Glista et al. | 385/103 |
| 4,123,899 | A | 11/1978 | Windelbandt et al. | |
| 4,128,293 | A | 12/1978 | Paoli | |
| 4,206,958 | A | 6/1980 | Hall et al. | |
| 4,218,581 | A | 8/1980 | Suzuki | 174/117 F |
| 4,462,657 | A | 7/1984 | Snowdon et al. | 439/840 |
| 4,463,323 | A | 7/1984 | Piper | 333/1 |
| 4,508,401 | A | 4/1985 | Casciotti et al. | 439/98 |
| 4,518,648 | A | 5/1985 | Miyata et al. | 442/9 |
| 4,568,138 | A | 2/1986 | McKenzie | |
| 4,639,054 | A * | 1/1987 | Kersbergen | 439/59 |

(Continued)

FOREIGN PATENT DOCUMENTS

| | | |
|---|---|---|
| EP | 0512714 | 11/1992 |

(Continued)

*Primary Examiner*—Michael C. Zarroli
(74) *Attorney, Agent, or Firm*—Wilmer Cutler Pickering Hale and Dorr LLP

(57) ABSTRACT

The present disclosure is directed to electrical switches that utilize conductors that are woven onto loading fibers and a mating conductor that has a contact mating surface. Each conductor has at least one contact point. The loading fibers are capable of delivering a contact force at each contact point of the conductors. Electrical connections are established between the contact points of conductors and the contact mating surface of the mating conductor when the conductor-loading fiber weave is engaged with the mating conductor and the electrical connections are terminated when the conductor-loading fiber weave is disengaged from the mating conductor.

53 Claims, 30 Drawing Sheets

U.S. PATENT DOCUMENTS

| | | | | |
|---|---|---|---|---|
| 4,651,163 | A | 3/1987 | Sutera | 347/76 |
| 4,664,185 | A | 5/1987 | Barnard | |
| 4,710,594 | A | 12/1987 | Walling et al. | 174/120 SR |
| 4,741,707 | A | 5/1988 | Mondor | 439/417 |
| 4,753,616 | A | 6/1988 | Molitor | |
| 4,755,422 | A | 7/1988 | Headrick | 442/7 |
| 4,778,950 | A | 10/1988 | Lee et al. | 174/356 C |
| 4,813,881 | A | 3/1989 | Kirby | |
| 4,820,170 | A | 4/1989 | Redmond et al. | 439/66 |
| 4,820,207 | A | 4/1989 | Zic | |
| 4,929,803 | A | 5/1990 | Yoshida et al. | 174/117 M |
| 4,940,426 | A | 7/1990 | Redmond et al. | 439/495 |
| 4,956,524 | A | 9/1990 | Karkow | 174/117 M |
| 5,015,197 | A | 5/1991 | Redmond et al. | 439/329 |
| 5,070,605 | A | 12/1991 | Daglow et al. | 29/842 |
| 5,073,124 | A | 12/1991 | Powell | |
| 5,109,596 | A | 5/1992 | Driller et al. | 29/705 |
| 5,163,837 | A | 11/1992 | Rowlette | 439/91 |
| 5,176,535 | A | 1/1993 | Redmond et al. | 439/495 |
| 5,190,471 | A | 3/1993 | Barile et al. | 439/455 |
| 5,273,438 | A | 12/1993 | Bradley et al. | 439/66 |
| 5,281,160 | A | 1/1994 | Walkup et al. | |
| 5,447,442 | A | 9/1995 | Swart | 439/77 |
| 5,468,164 | A | 11/1995 | Demissey | 439/843 |
| 5,469,072 | A | 11/1995 | Williams | 324/754 |
| 5,533,693 | A | 7/1996 | Abildskov | |
| 5,564,931 | A | 10/1996 | Fabian et al. | |
| 5,565,654 | A | 10/1996 | Zell et al. | |
| 5,635,677 | A | 6/1997 | Wood et al. | 174/117 F |
| 5,645,459 | A | 7/1997 | Fitting | 439/857 |
| 5,676,571 | A | 10/1997 | Matthews | |
| 5,880,402 | A | 3/1999 | Nugent | 174/27 |
| 5,899,755 | A | 5/1999 | Kline | 439/66 |
| 5,899,766 | A | 5/1999 | DeFeo | 439/218 |
| 6,086,432 | A | 7/2000 | Frinker et al. | |
| 6,102,746 | A | 8/2000 | Nania et al. | 439/675 |
| 6,135,783 | A | 10/2000 | Rathburn | 439/66 |
| 6,210,771 | B1 | 4/2001 | Post et al. | 428/100 |
| 6,250,966 | B1 | 6/2001 | Hashimoto et al. | 439/631 |
| 6,264,476 | B1 | 7/2001 | Li et al. | |
| 6,313,523 | B1 | 11/2001 | Morris et al. | 257/696 |
| 6,386,890 | B1 | 5/2002 | Bhatt et al. | |
| 6,388,885 | B1 | 5/2002 | Alexander et al. | |
| 6,439,894 | B1 | 8/2002 | Li | |
| 6,471,555 | B1 | 10/2002 | Creze | |
| 6,666,690 | B1 | 12/2003 | Ishizuka et al. | |
| 6,762,941 | B1 | 7/2004 | Roth | 361/736 |
| 6,852,395 | B1 | 2/2005 | Dhawan et al. | |
| 6,942,496 | B1 | 9/2005 | Sweetland et al. | |
| 2002/0016108 | A1 | 2/2002 | Creze | 439/843 |
| 2002/0117791 | A1 | 8/2002 | Hembree et al. | 267/152 |
| 2003/0176083 | A1 | 9/2003 | Li et al. | 439/66 |
| 2004/0171284 | A1 | 9/2004 | Sweetland et al. | 439/67 |
| 2004/0214454 | A1 | 10/2004 | Sweetland et al. | 439/67 |

FOREIGN PATENT DOCUMENTS

| | | |
|---|---|---|
| EP | 0901191 | 3/1999 |
| EP | 0932172 | 7/1999 |
| JP | 61185818 | 8/1986 |
| JP | 06176624 | 6/1994 |
| JP | 06251819 | 9/1994 |
| JP | 07037433 | 2/1995 |
| JP | 08106939 | 4/1996 |
| WO | WO 95/08910 | 3/1995 |
| WO | WO 01/75788 | 10/2001 |

* cited by examiner

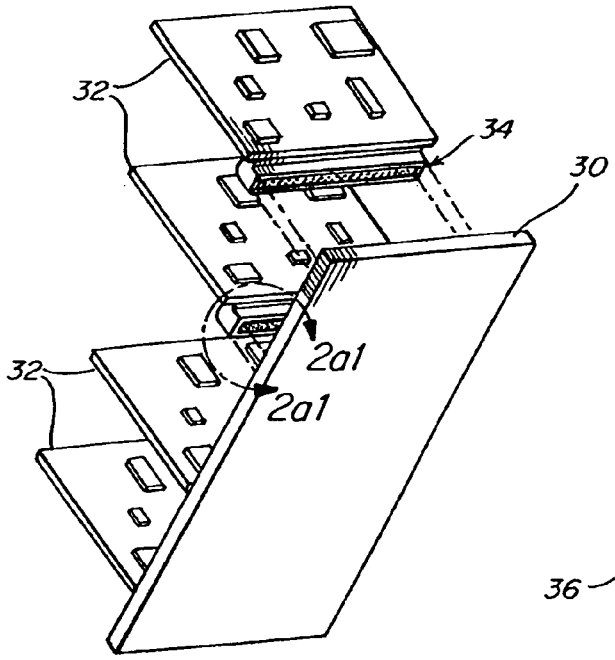
Fig. 2a
(PRIOR ART)
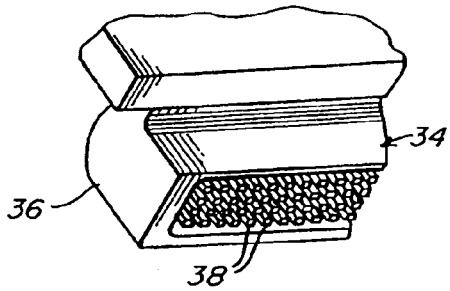
Fig. 2a1
(PRIOR ART)
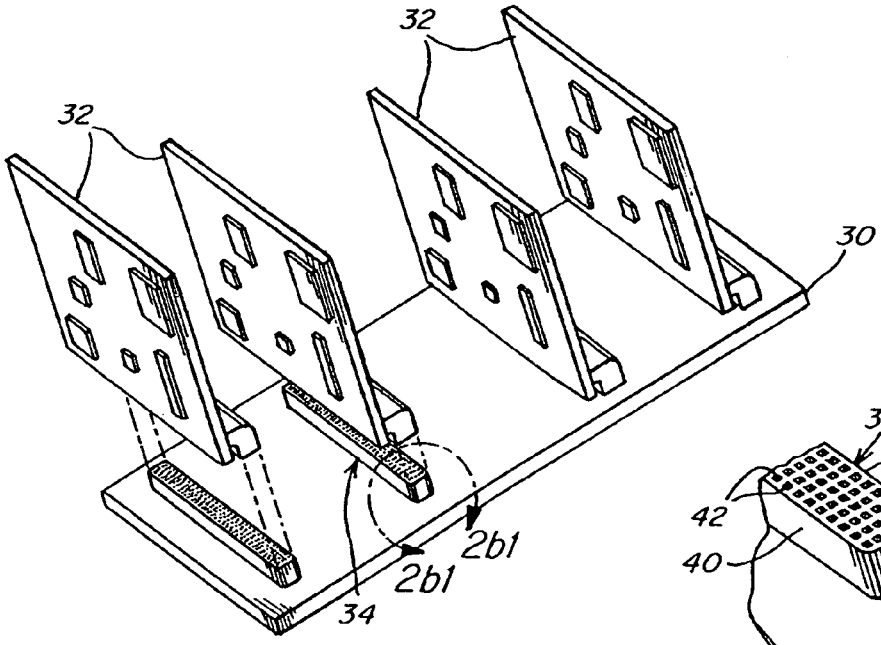
Fig. 2b
(PRIOR ART)
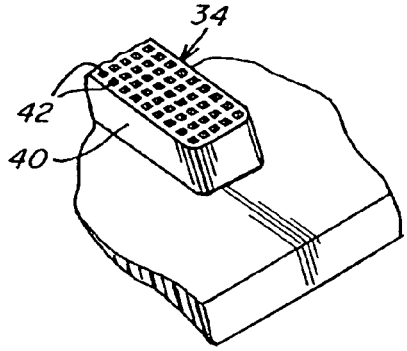
Fig. 2b1
(PRIOR ART)

80
84
91
90
96
104
96
104
90
86
116
89
118a
118b
120

86
88
80
84
104
90
86
96
96
116
89
120
118a
120
118b

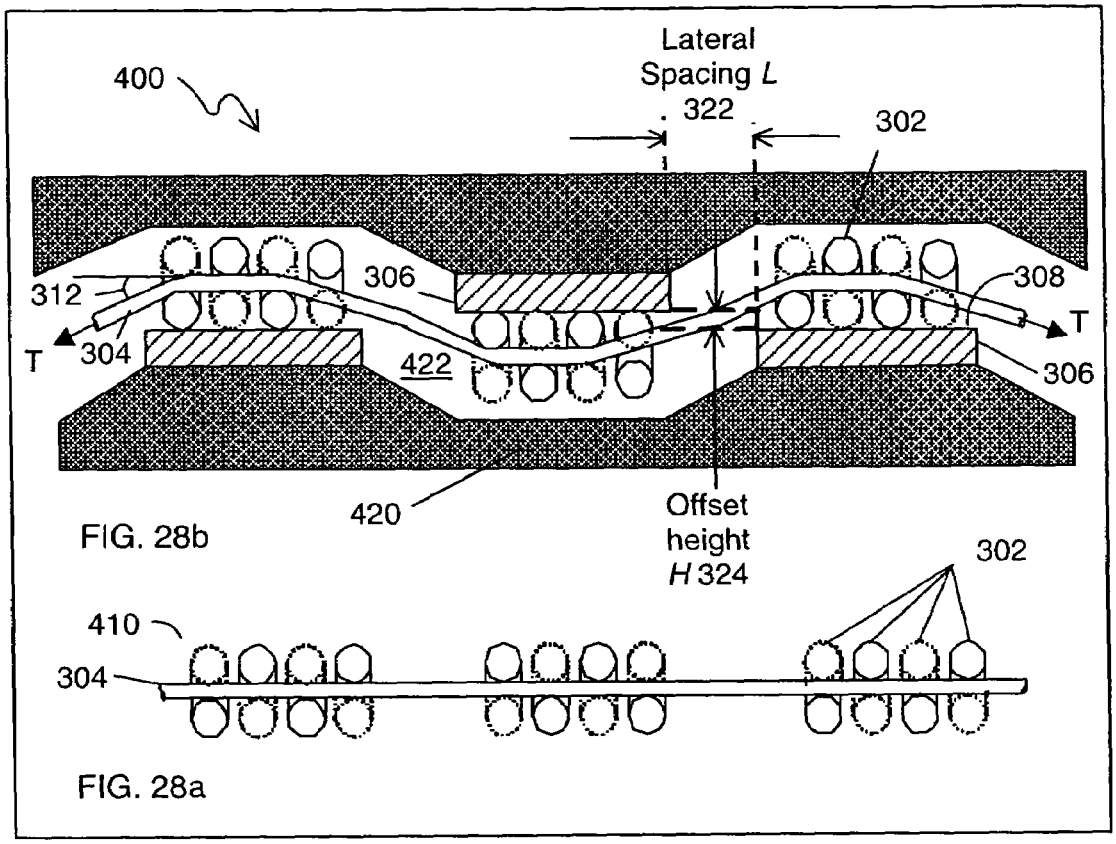
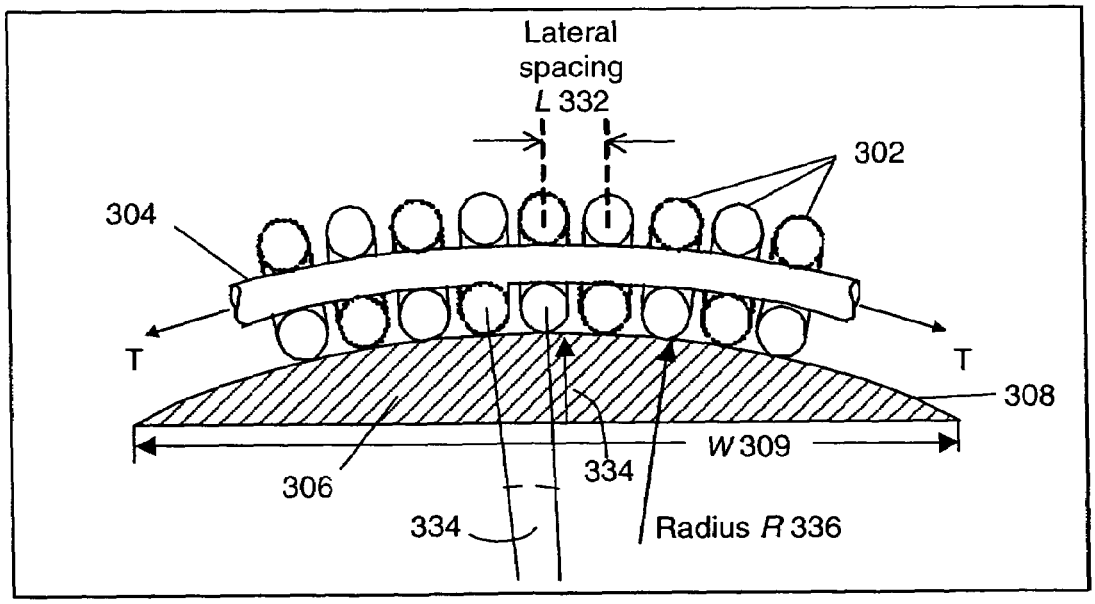
FIG. 29

MULTIPLE-CONTACT WOVEN ELECTRICAL SWITCHES

CROSS-REFERENCE TO RELATED APPLICATIONS

This patent application claims priority to U.S. Provisional Patent Application No. 60/486,363 filed Jul. 11, 2003.

FIELD OF THE INVENTION

The present invention is directed to electrical switches, and in particular to multi-contact woven electrical switches.

BACKGROUND

Components of electrical systems sometimes need to be interconnected using electrical connectors and/or switches to provide an overall, functioning system. These components may vary in size and complexity, depending on the type of system. For example, referring to FIG. 1, a system may include a backplane assembly comprising a backplane or motherboard 30 and a plurality of daughter boards 32 that may be interconnected using a connector 34, which may include an array of many individual pin connections for different traces etc., on the boards. For example, in telecommunications applications where the connector connects a daughter board to a backplane, each connector may include as many as 2000 pins or more. Alternatively, the system may include components that may be connected using a single-pin coaxial or other type of connector, and many variations in-between. Regardless of the type of electrical system, advances in technology have led electronic circuits and components to become increasingly smaller and more powerful. However, individual connectors are still, in general, relatively large compared to the sizes of circuit traces and components.

Referring to FIGS. 2*a* and 2*b*, there are illustrated perspective views of the backplane assembly of FIG. 1. FIG. 2*a* also illustrates an enlarged section of the male portion of connector 34, including a housing 36 and a plurality of pins 38 mounted within the housing 36. FIG. 2*b* illustrates an enlarged section of the female portion of connector 34 including a housing 40 that defines a plurality of openings 42 adapted to receive the pins 38 of the male portion of the connector. 34 including a housing 40 that defines a plurality of openings 42 adapted to receive the pins 38 of the male portion of the connector.

A portion of the connector 34 is shown in more detail in FIG. 3*a*. Each contact of the female portion of the connector includes a body portion 44 mounted within one of the openings (FIG. 2*b*, 42). A corresponding pin 38 of the male portion of the connector is adapted to mate with the body portion 44. Each pin 38 and body portion 44 includes a termination contact 48. As shown in FIG. 3*b*, the body portion 44 includes two cantilevered arms 46 adapted to provide an "interference fit" for the corresponding pin 38. In order to provide an acceptable electrical connection between the pin 38 and the body portion 44, the cantilevered arms 46 are constructed to provide a relatively high clamping force. Thus, a high normal force is required to mate the male portion of the connector with the female portion of the connector. This may be undesirable in many applications, as will be discussed in more detail below.

When the male portion of the conventional connector is engaged with the female portion, the pin 38 performs a "wiping" action as it slides between the cantilevered arms 46, requiring a high normal force to overcome the clamping force of the cantilevered arms and allow the pin 38 to be inserted into the body portion 44. There are three components of friction between the two sliding surfaces (the pin and the cantilevered arms) in contact, namely asperity interactions, adhesion and surface plowing. Surfaces, such as the pin 38 and cantilevered arms 46, that appear flat and smooth to the naked eye are actually uneven and rough under magnification. Asperity interactions result from interference between surface irregularities as the surfaces slide over each other. Asperity interactions are both a source of friction and a source of particle generation. Similarly, adhesion refers to local welding of microscopic contact points on the rough surfaces that results from high stress concentrations at these points. The breaking of these welds as the surfaces slide with respect to one another is a source of friction.

In addition, particles may become trapped between the contacting surfaces of the connector. For example, referring to FIG. 4*a*, there is illustrated an enlarged portion of the conventional connector of FIG. 3*b*, showing a particle 50 trapped between the pin 38 and cantilevered arm 46 of connector 34. The clamping force 52 exerted by the cantilevered arms must be sufficient to cause the particle to become partially embedded in one or both surfaces, as shown in FIG. 4*b*, such that electrical contact may still be obtained between the pin 38 and the cantilevered arm 46. If the clamping force 52 is insufficient, the particle 50 may prevent an electrical connection from being formed between the pin 38 and the cantilevered arm 46, which results in failure of the connector 34. However, the higher the clamping force 52, the higher must be the normal force required to insert the pin 38 into the body portion 44 of the female portion of the connector 34. When the pin slides with respect to the arms, the particle cuts a groove in the surface(s). This phenomenon is known as "surface plowing" and is a third component of friction.

Referring to FIG. 5, there is illustrated an enlarged portion of a contact point between the pin 38 and one of the cantilevered arms 46, with a particle 50 trapped between them. When the pin slides with respect to the cantilevered arm, as indicated by arrow 54, the particle 50 plows a groove 56 into the surface 58 of the cantilevered arm and/or the surface 60 of the pin. The groove 56 causes wear of the connector, and may be particularly undesirable in gold-plated connectors where, because gold is a relatively soft metal, the particle may plow through the gold-plating, exposing the underlying substrate of the connector. This accelerates wear of the connector because the exposed connector substrate, which may be, for example, copper, can easily oxidize. Oxidation can lead to more wear of the connector due to the presence of oxidized particles, which are very abrasive. In addition, oxidation leads to degradation in the electrical contact over time, even if the connector is not removed and re-inserted.

One conventional solution to the problem of particles being trapped between surfaces is to provide one of the surface with "particle traps." Referring to FIGS. 6*a–c*, a first surface 62 moves with respect to a second surface 64 in a direction shown by arrow 66. When the surface 64 is not provided with particle traps, a process called agglomeration causes small particles 68 to combine as the surfaces move and form a large agglomerated particle 70, as illustrated in the sequence of FIGS. 6*a*–6*c*. This is undesirable, as a larger particle means that the clamping force required to break through the particle, or cause the particle to become embedded in one or both of the surfaces, so that an electrical connection can be established between surface 62 and surface 64 is very high. Therefore, the surface 64 may be provided with particle traps 72, as illustrated in FIGS. 6*d*–6*g*, which are small recesses in the surface as shown. When surface 62 moves over surface 64, the particle 68 is pushed into the particle trap 72, and is thus no longer available to cause plowing or to interfere with the electrical connection between surface 62 and surface 64. However, a disadvantage of these conventional particle traps is that it is significantly more difficult to machine surface 64 with traps than without, which adds to the cost of the connector. The particle traps also produce features that are prone to increased stress and fracture, and thus the connector is more likely to suffer a catastrophic failure than if there were no particle traps present.

An electrical switch is a basic element used for control of current in a circuit. An electrical switch (referred to hereafter as "switch") is a device for making or breaking an electric circuit. Like electrical connectors, there are hundreds of different types of switches used in a variety of diverse applications. Precision snap acting switches, toggle switches and pushbutton switches are used in applications ranging from production machinery and submarines to medical instruments. Another type of switch, a rotary switch, is actuated by a rotational force applied to a shaft. An example of a rotary switch is an automotive directional indicator lever. Other types of switches, membrane, metal dome and conductive rubber switches, are commonly used in calculators, cell phones and computer keypads.

Despite the huge variation in switch technology, at a fundamental level the underlying physics and mechanics are similar. The contacts which make and break the circuit should have low resistance. This includes both the contact bulk resistance and the interfacial resistance between both contacts. Also, the contacts may have to open and close many times during its lifetime (over a million cycles is not uncommon) so contact friction and wear are important parameters. When a switch makes or breaks an electric circuit, an arc is produced at the contacts. The magnitude and duration of the arc is a function of many variables including AC or DC supply source, inductive or capacitive load, voltage and current magnitude, and rate at which the switch makes/breaks a circuit. If a large arc is produced, this can lead to contact damage.

The inventors have developed a novel conductive weave technology, which is also described in U.S. patent application Ser. No. 10/603,047, filed Jun. 24, 2003, U.S. patent application Ser. No. 10/375,481, filed Feb. 27, 2003, and U.S. patent application Ser. No. 10/273,241, filed Oct. 17, 2002, the entireties of which are herein incorporated by reference. The inventive conductive weave technology offers many advantages to switches, including lower contact resistance, lower friction, lower wear, and more redundant contact points, the combination of which results in smaller, more reliable, more rugged and longer lasting switches.

SUMMARY OF THE INVENTION

The present disclosure is directed to electrical switches that utilize conductors that are woven onto loading fibers and a mating conductor that has a contact mating surface. Each conductor has at least one contact point. The loading fibers are capable of delivering a contact force at each contact point of the conductors. Electrical connections are established between the contact points of conductors and the contact mating surface of the mating conductor when the conductor-loading fiber weave is engaged with the mating conductor and the electrical connections are terminated when the conductor-loading fiber weave is disengaged from the mating conductor. The switch can include an actuator system that operates to engage and disengage the switch. In certain embodiments, the mating conductor is substantially rod-shaped (e.g., a pin) and the conductor-loading fiber weave is tube-shaped.

As the conductor-loading fiber weave engages and disengages the mating conductor, arcing between the conductors and the contact mating surface of the mating conductor will occur. In one embodiment, the portion of the contact mating surface of the mating conductor where arcing between the conductors and the mating conductor is expected to occur is plated with a conductive arc-tolerant material, such as silver, for example. In another embodiments, the portions of the conductors where arcing is expected to occur are plated with a conductive arc-tolerant material. In an alternate embodiment, the conductors are made thicker where arcing between the conductors and the mating conductor is expected to occur.

In certain embodiments, the contact mating surface of the mating conductor includes conductive and non-conductive portions. The non-conductive portion can assist in guiding the conductor-loading fiber weave when its being engaged and disengaged from the mating conductor. The contact points of the conductors engage at least a portion of the non-conductive portion when the switch is in an open, disengaged position and at least one contact point of a conductor engages at least a portion of the conductive portion when the switch is in a closed, engaged position. The non-conductive portion is preferably comprised of a low friction material, such as Teflon, for example.

In some embodiments, the non-conductive portion of the contact mating surface is radially disposed at one end of the mating conductor and the conductive portion of the contact mating surface is radially disposed adjacent to the non-conductive portion. A conductive arc-resistant material can be disposed over a section of the conductive portion adjacent to the non-conductive portion or, alternatively, over a section of the non-conductive portion adjacent to the conductive portion.

In certain other embodiments, the non-conductive portion of the contact mating surface is disposed along the length of the mating conductor while the conductive portion of the contact mating surface is disposed along the length of the mating conductor adjacent to the non-conductive portion. A conductive arc-resistant material can be disposed over a section of the conductive portion adjacent to the non-conductive portion or, alternatively, over a section of the non-conductive portion adjacent to the conductive portion.

The switch can further include tensioning guides. In one embodiment, a conductor is disposed between two tensioning guides and woven onto a loading fiber so that portions of the loading fiber contact the two tensioning guides when the switch is in a closed position. The tensioning guides can be comprised of support columns.

In certain embodiments, a plurality of loading fibers can be arranged to form a grid having a plurality of intersections. The conductors can be woven onto one or more of the loading fibers at or near an intersection of the grid.

In an alternative embodiment, the contact mating surface of the mating conductor includes a plurality of non-conductive sections and a plurality of conductive sections, wherein the contact point of conductors engage at least a portion of the non-conductive sections when the switch is in an open position and wherein a contact point of at least one conductor engages a portion of the conductive sections when the switch is in a closed position.

In one exemplary embodiment, the switch includes a first and second sets of conductors being woven with a plurality of loading fibers wherein the first set of conductors defines a first electrical path and the second set of conductors defines a second electrical path that is electrically isolated from the first electrical path.

In another exemplary embodiment, the switch includes first set of conductors woven with a first set of loading fibers and a second set of conductors woven with a second set of loading fibers wherein the first set of conductors defines a first electrical path and the second set of conductors defines a second electrical path that is electrically isolated from the first electrical path.

BRIEF DESCRIPTION OF THE DRAWINGS

The foregoing and other features and advantages of the present invention will be apparent from the following non-limiting discussion of various embodiments and aspects thereof with reference to the accompanying figures. The figures are provided for the purposes of illustration and explanation, and are not intended to limit the breadth of the present disclosure.

FIG. 2*a* is a perspective view of a conventional backplane assembly showing an enlarged portion of a conventional male connector element;

FIG. 2*b* is a perspective view of a conventional backplane assembly showing an enlarged portion of a conventional female connector element;

FIGS. 28*a* and 28*b* are cross-sectional views of one woven connector embodiment in accordance with the teachings of the present disclosure;

FIG. 29 is an enlarged cross-sectional view of a woven connector embodiment having a convex contact mating surface;

DETAILED DESCRIPTION

Figure 1:
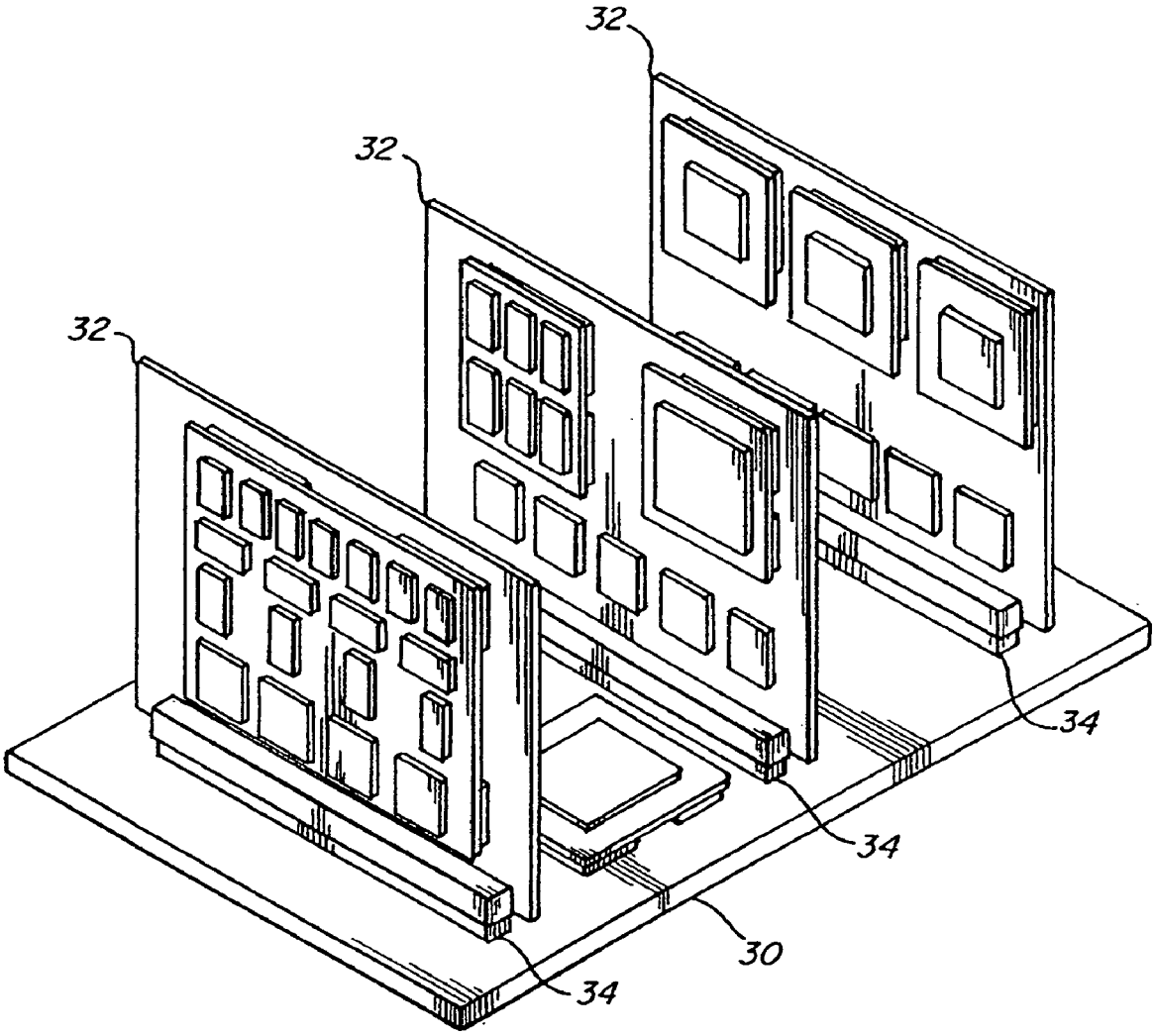
Fig. 1 (PRIOR ART)
FIG. 1 is a perspective view of a conventional backplane assembly.

The present invention provides an electrical connector that may overcome the disadvantages of prior art connectors. The invention comprises an electrical connector capable of very high density and using only a relatively low normal force to engage a connector element with a mating connector element. It is to be understood that the invention is not limited in its application to the details of construction and the arrangement of components set forth in the following description or illustrated in the drawings. Other embodiments and manners of carrying out the invention are possible. Also, it is to be understood that the phraseology and terminology used herein is for the purpose of description and should not be regarded as limiting. The use of "including," "comprising," or "having" and variations thereof is meant to encompass the items listed thereafter and equivalents thereof as well as additional items. In addition, it is to be appreciated that the term "connector" as used herein refers to each of a plug and jack connector element and to a combination of a plug and jack connector element, as well as respective mating connector elements of any type of connector and the combination thereof. It is also to be appreciated that the term "conductor" refers to any electrically conducting element, such as, but not limited to, wires, conductive fibers, metal strips, metal or other conducting cores, etc.

Figure 7:
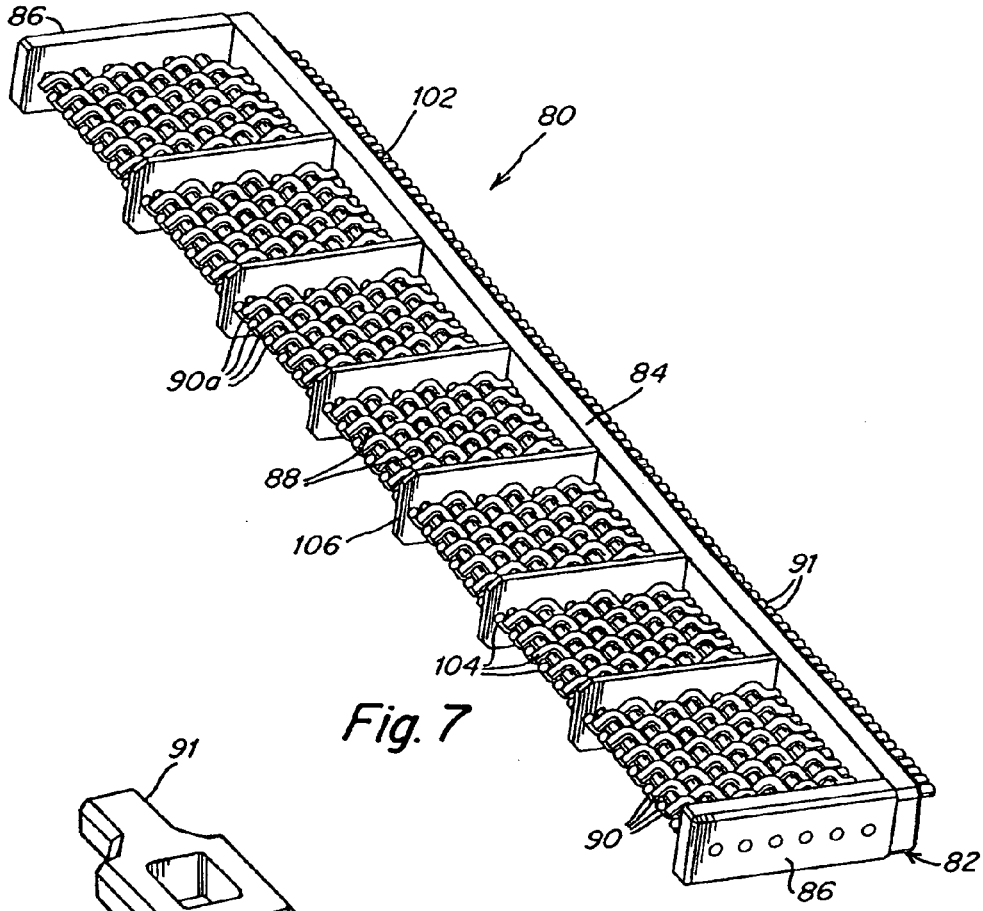
FIG. 7 is a perspective view of one embodiment of a woven connector according to aspects of the present disclosure.

Referring to FIG. 7, there is illustrated one embodiment of a connector according to aspects of the invention. The connector 80 includes a housing 82 that may include a base member 84 and two end walls 86. A plurality of non-conductive fibers 88 may be disposed between the two end walls 86. A plurality of conductors 90 may extend from the base member 84, substantially perpendicular to the plurality of non-conductive fibers 88. The plurality of conductors 90 may be woven with the plurality of non-conductive fibers so as to form a plurality of peaks and valleys along a length of each of the plurality of conductors, thereby forming a woven connector structure. Resulting from the weave, each conductor may have a plurality of contact points positioned along the length of each of the plurality of conductors, as will be discussed in more detail below.

In one embodiment, a number of conductors 90*a*, for example, four conductors, may together form one electrical contact. However, it is to be appreciated that each conductor may alone form a separate electrical contact, or that any number of conductors may be combined to form a single electrical contact. The connector of FIG. 7 may be include termination contacts 91 which may be permanently or removably connected to, for example, a backplane or daughter board. In the illustrated example, the termination contacts 91 are mounted to a plate 102 that may be mounted to the base member 84 of housing 82. Alternatively, the termination may be connected directly to the base member 84 of the housing 82. The base member 84 and/or end walls 86 may also be used to secure the connector 80 to the backplane or daughter board. The connector of FIG. 7 may be adapted to engage with one or more mating connector elements, as discussed below.

Figure 8:
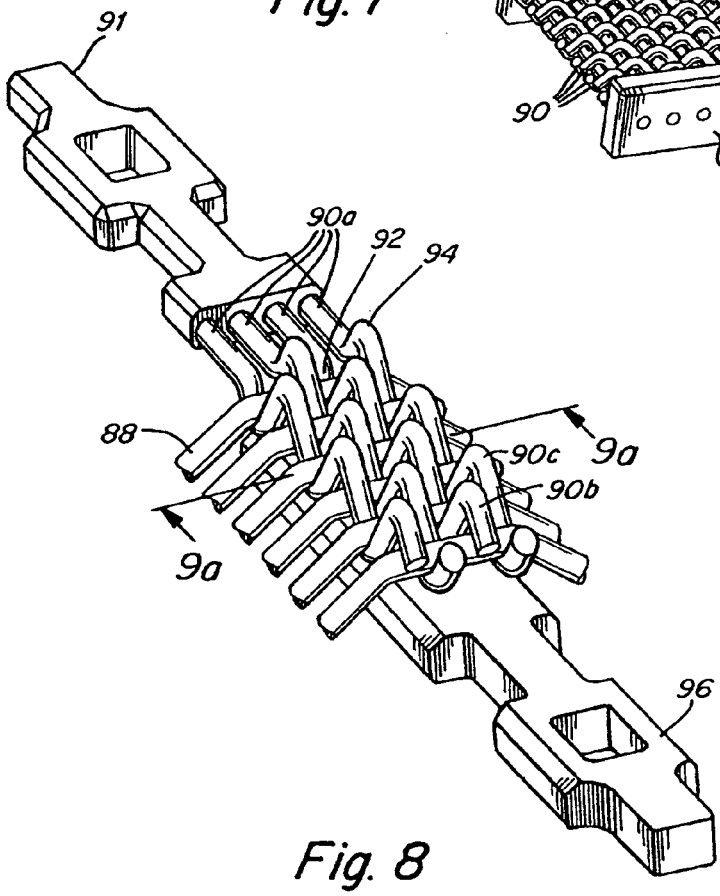
FIG. 8 is a perspective view of an example of an enlarged portion of the woven connector of FIG. 7.
Figures 15A, 15B:
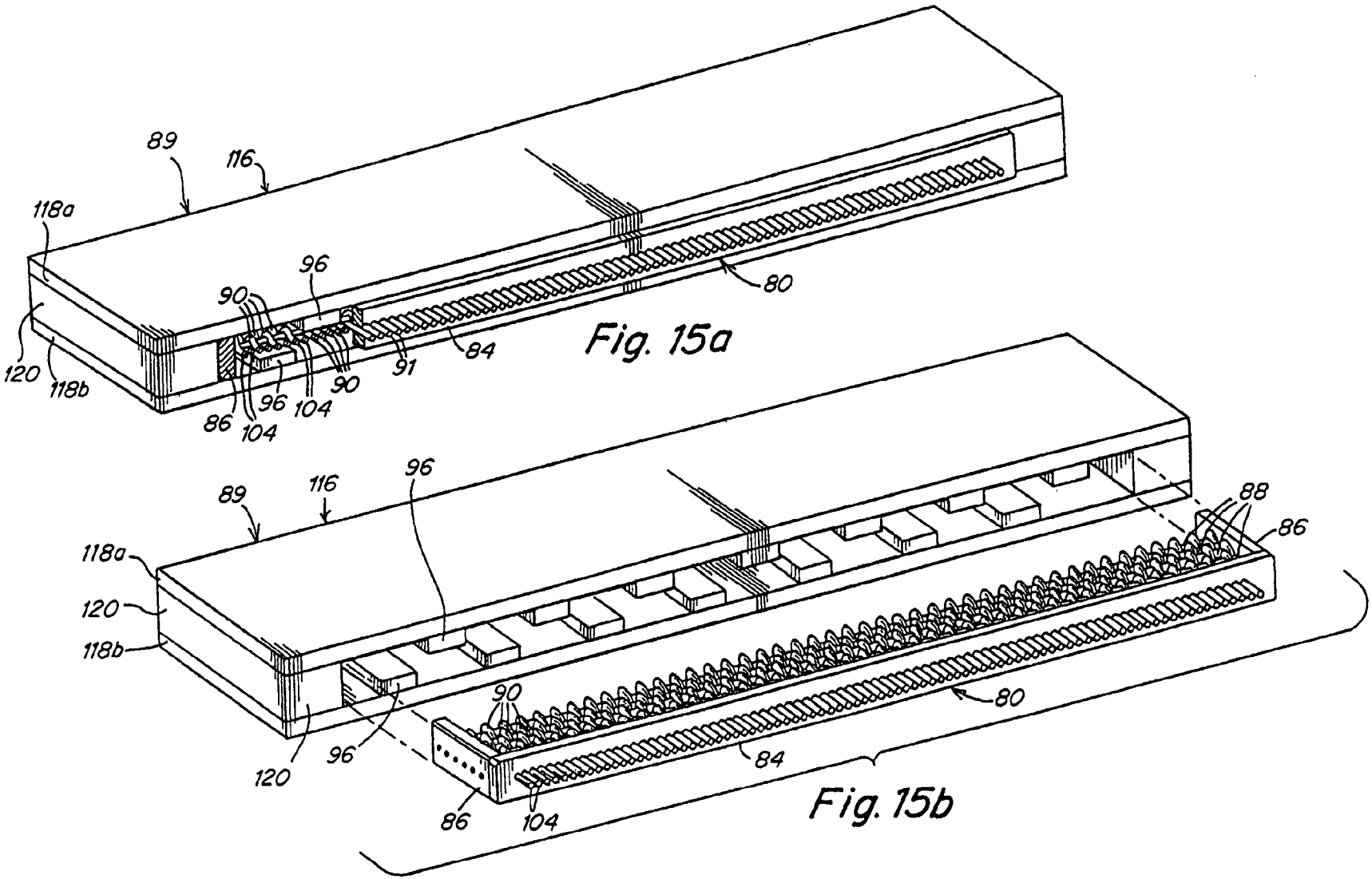
FIG. 15*a* is a perspective view of the connector of FIG. 7, mated with a mating connector element.
FIG. 15*b* is a perspective view of the connector of FIG. 7, mated with a mating connector element.

FIG. 8 illustrates an example of an enlarged portion of the connector 80, illustrating one electrical contact comprising the four conductors 90*a*. The four conductors 90*a* may be connected to a common termination contact 91. It is to be appreciated that the termination contact 91 need not have the shape illustrated, but may have any suitable configuration for termination to, for example, a semiconductor device, a circuit board, a cable, etc. According to one example, the plurality of conductors 90*a* may include a first conductor 90*b* and a second conductor 90*c* located adjacent the first conductor 90*b*. The first and second conductors may be woven with the plurality of nonconductive fibers 88 such that a first one of the non-conductive fibers 88 passes over a valley 92 of the first conductor 90*b* and under a peak 94 of the second conductor 90*c*. Thus, the plurality of contact points along the length of the conductors may be provided by either the valleys or the peaks, depending on where a contacting mating connector is located. A mating contact 96, illustrated in FIG. 8, may form part of a mating connector element 97 that may be engaged with the connector 80, as illustrated in FIG. 15*b*. As shown in FIG. 8, at least some of the valleys of the conductors 90*a*provide the plurality of contact points between the conductors 90*a* and the mating contact 96. It is also to be appreciated that the mating contact need not have the shape illustrated, but may have any suitable configuration for termination to, for example, a semiconductor device, a circuit board, a cable, etc.

According to one embodiment, tension in the weave of the connector 80 may provide a contact force between the conductors of the connector 80 and the mating connector 96. In one example, the plurality of non-conductive fibers 88 may comprise an elastic material. The elastic tension that may be generated in the non-conductive fibers 88 by stretching the elastic fibers, may be used to provide the contact force between the connector 80 and the mating contact 96. The elastic non-conductive fibers may be prestretched to provide the elastic force, or may be mounted to tensioning mounts, as will be discussed in more detail below.

Figure 9A:
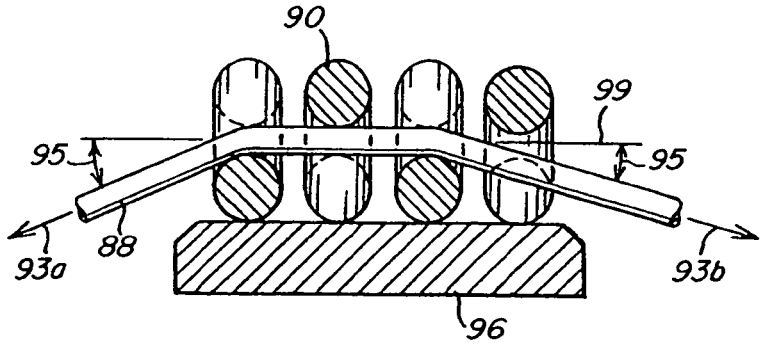
FIGS. 9*a* and 9*b* are enlarged cross-sectional views of a portion of the connector of FIG. 8.
Figure 9B:
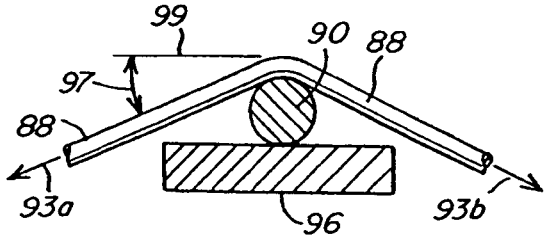

Referring to FIG. 9*a*, there is illustrated an enlarged cross-sectional view of the connector of FIG. 8, taken along line A—A in FIG. 8. The elastic non-conductive fiber 88 may be tensioned in the directions of arrows 93*a* and 93*b*, to provide a predetermined tension in the non-conductive fiber, which in turn may provide a predetermined contact force between the conductors 90 and the mating contact 96. In the example illustrated in FIG. 9*a*, the non-conductive fiber 88 may be tensioned such that the non-conductive fiber 88 makes an angle 95 with respect to a plane 99 of the mating conductor 96, so as to press the conductors 90 against the mating contact 96. In this embodiment, more than one conductor 90 may be making contact with the mating conductor 96. Alternatively, as illustrated in FIG. 9*b*, a single conductor 90 may be in contact with any single mating conductor 96, providing the electrical contact as discussed above. Similar to the previous example, the non-conductive fiber 88 is tensioned in the directions of the arrows 93*a* and 93*b*, and makes an angle 97 with respect to the plane of the mating contact 96, on either side of the conductor 90.

Figure 10:
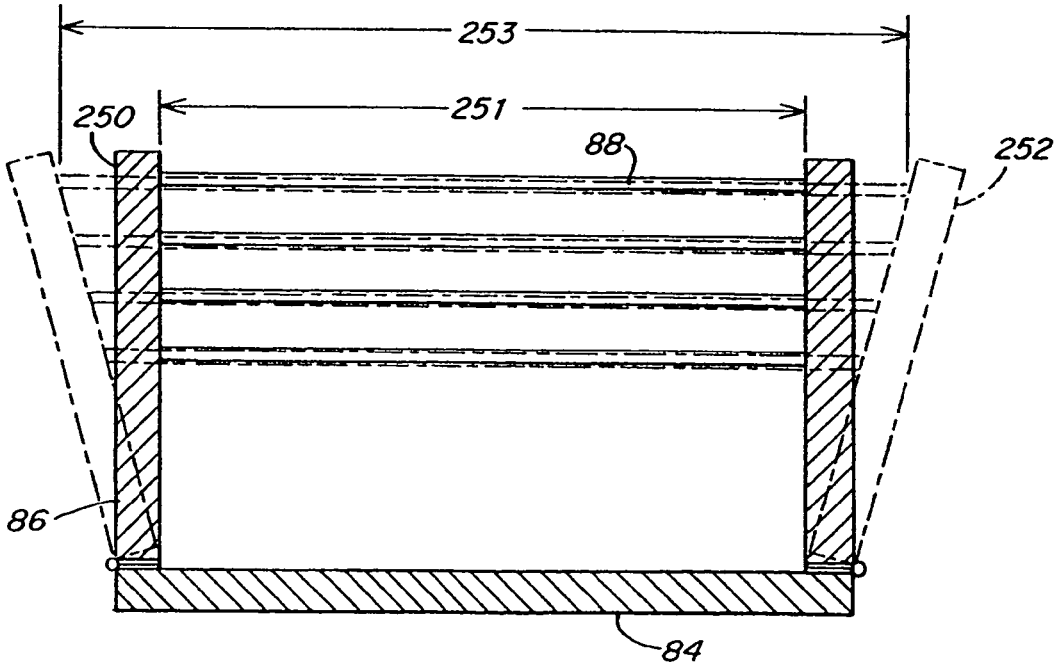
FIG. 10 is a simplified cross-sectional view of the connector of FIG. 7 with movable, tensioning end walls.

As discussed above, the elastic non-conductive fibers 88 may be attached to tensioning mounts. For example, the end walls 86 of the housing may act as tensioning mounts to provide a tension in the non-conductive fibers 88. This may be accomplished, for example, by constructing the end walls 86 to be movable between a first, or rest position 250 and a second, or tensioned, position 252, as illustrated in FIG. 10. Movement of the end walls 86 from the rest position 250 to the tensioned position 252 causes the elastic non-conductive fibers 88 to be stretched, and thus tensioned. As illustrated, the length of the non-conductive fibers 88 may be altered between a first length 251 of the fibers when the tensioning mounts are in the rest position 250, (when no mating connector is engaged with the connector 80), and a second length 253 when the tensioning mounts are in the tensioned position 252 (when a mating connector is engaged with the connector 80). This stretching and tensioning of the non-conductive fibers 88 may in turn provide contact force between the conductive weave (not illustrated in FIG. 10 for clarity), and the mating contact, when the mating connector is engaged with the connector element.

Figure 11:
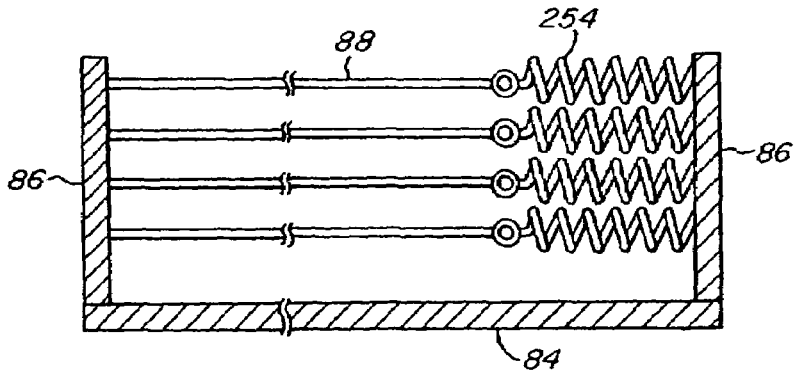
FIG. 11 is a simplified cross-sectional view of the connector of FIG. 7 including spring members attaching the non-conductive weave fibers to the end walls.
Figure 12:
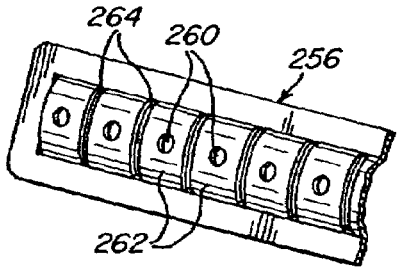
FIG. 12 is a perspective view of another example of a tensioning mount.

According to another example, illustrated in FIG. 11, springs 254 may be provided connected to one or both ends of the non-conductive fibers 88 and to a corresponding one or both of the end walls 86, the springs providing the elastic force. In this example, the non-conductive fibers 88 may be non-elastic, and may include an inelastic material such as, for example, a polyamid fiber, a polyaramid fiber, and the like. The tension in the non-conductive weave may be provided by the spring strength of the springs 254, the tension in turn providing contact force between the conductive weave (not illustrated for clarity) and conductors of a mating connector element. In yet another example, the non-conductive fibers 88 may be elastic or inelastic, and may be mounted to tensioning plates 256 (see FIG. 12), which may in turn be mounted to the end walls 86, or may be the end walls 86. The tensioning plates may comprise a plurality of spring members 262, each spring member defining an opening 260, and each spring member 262 being separated from adjacent spring members by a slot 264. Each non-conductive fiber may be threaded through a corresponding opening 260 in the tensioning plate 256, and may be mounted to the tensioning plate, for example, glued to the tensioning plate, or tied such that an end portion of the non-conductive fiber can not be unthreaded though the opening 260. The slots 264 may enable each spring member 262 to act independent of adjacent spring members, while allowing a plurality of spring members to be mounted on a common tensioning mount 256. Each spring member 262 may allow a small amount of motion, which may provide tension in the non-conductive weave. In one example, the tensioning mount 256 may have an arcuate structure, as illustrated in FIG. 12.

Figure 3A:
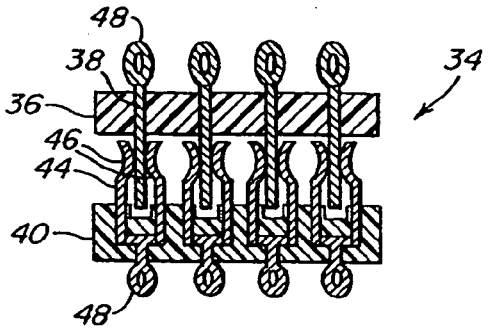
Fig. 3a (PRIOR ART)
FIG. 3*a* is a cross-sectional view of a conventional connector as may be used with the backplane assemblies of FIGS. 1, 2*a*, and 2*b;*
Figure 3B:
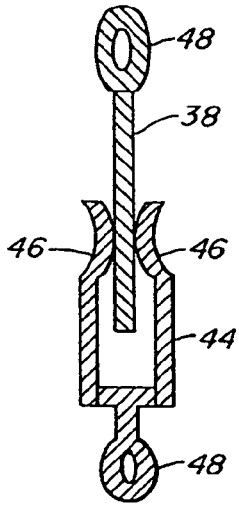
Fig. 3b (PRIOR ART)
FIG. 3*b* is an enlarged cross-sectional view of a single connection of the conventional connector of FIG. 3*a;*
Figure 4A:
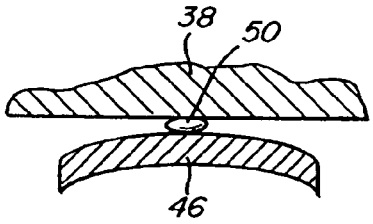
Fig. 4a (PRIOR ART)
FIG. 4*a* is an illustration of an enlarged portion of the conventional connector of FIG. 3*b*, showing a trapped particle.
Figure 4B:
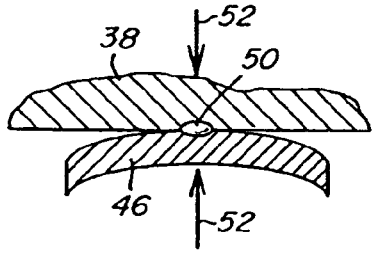
Fig. 4b (PRIOR ART)
FIG. 4*b* is an illustration of the enlarged connector portion of FIG. 4*a*, with the particle embedded into a surface of the connector.
Figure 5:
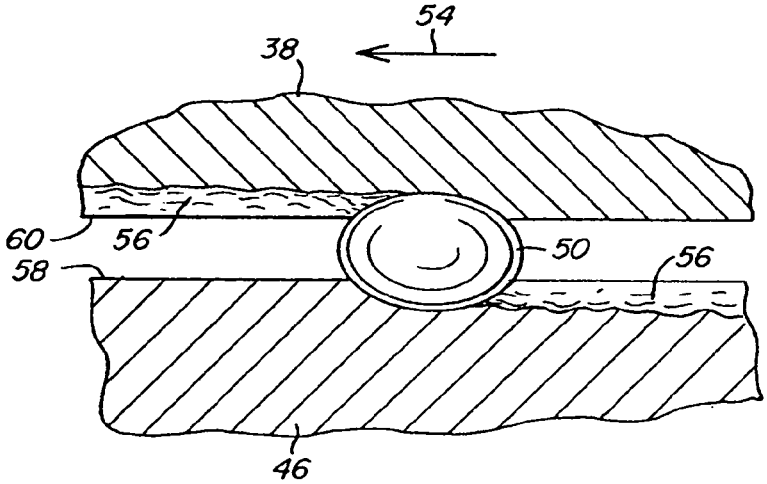
Fig. 5 (PRIOR ART)
FIG. 5 is a diagrammatic representation of an example of the plowing phenomenon.
Figure 6A:
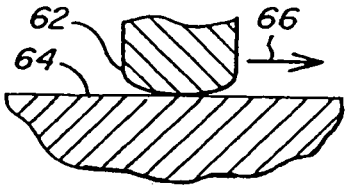
Fig. 6a (PRIOR ART)
FIGS. 6*a–g* are diagrammatic representations of particle agglomeration, with and without particle traps present in a connector.
Figure 6D:
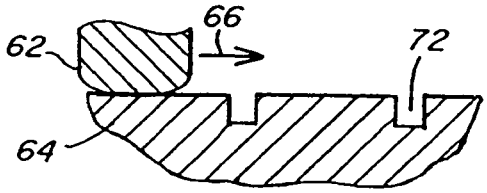
Fig. 6d (PRIOR ART)
Figure 6B:
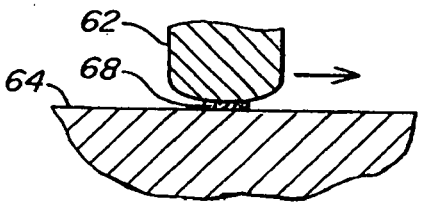
Fig. 6b (PRIOR ART)
Figure 6E:
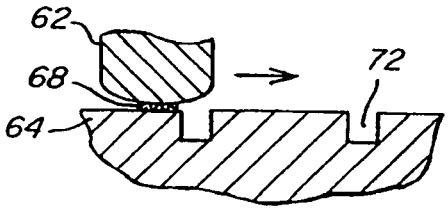
Fig. 6e (PRIOR ART)
Figure 6C:
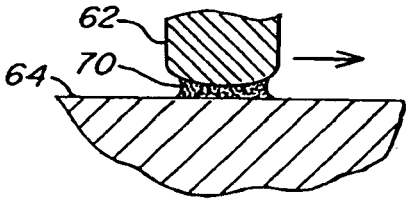
Fig. 6c (PRIOR ART)
Figure 6F:
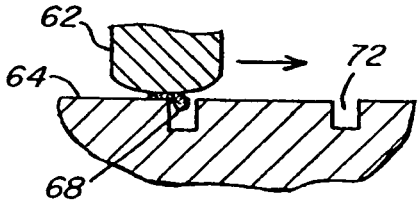
Fig. 6f (PRIOR ART)
Figure 6G:
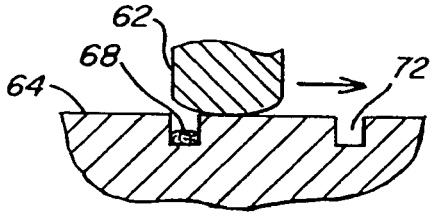
Fig. 6g (PRIOR ART)
Figure 13A:
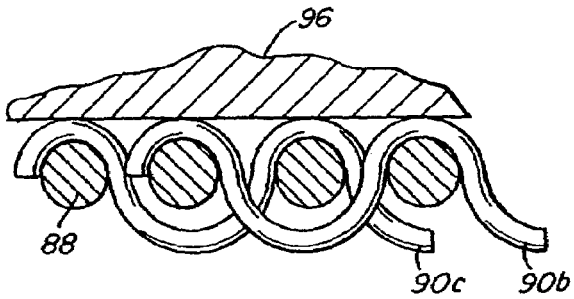
FIG. 13*a* is an enlarged cross-sectional view of the woven connector of FIGS. 7 and 8.
Figure 13B:
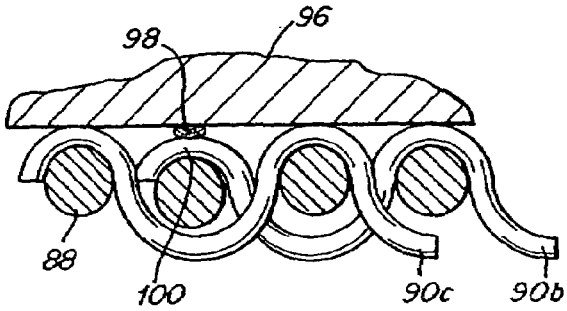
FIG. 13*b* is an enlarged cross-sectional view of the woven connector of FIGS. 7 and 8 with a particle.

According to one aspect of the invention, providing a plurality of discrete contact points along the length of the connector and mating connector may have several advantages over the single continuous contact of conventional connectors (as illustrated in FIGS. 3*a*, 3*b* and 4). For example, when a particle becomes trapped between the surfaces of a conventional connector, as shown in FIG. 4, the particle can prevent an electrical connection from being made between the surfaces, and can cause plowing which may accelerate wear of the connector. The applicants have discovered that plowing by trapped particles is a significant source of wear of conventional connectors. The problem of plowing, and resulting lack of a good electrical connection being formed, may be overcome by the woven connectors of the present invention. The woven connectors have the feature of being "locally compliant," which herein shall be understood to mean that the connectors have the ability to conform to a presence of small particles, without affecting the electrical connection being made between surfaces of the connector. Referring to FIGS. 13*a* and 13*b*, there are illustrated enlarged cross-sectional views of the connector of FIGS. 7 and 8, showing the plurality of conductors 90*a* providing a plurality of discrete contact points along the length of the mating connector element 96. When no particle is present, each peak/valley of conductors 90*a* may contact the mating contact 96, as shown in FIG. 13*a*. When a particle 98 becomes trapped between the connector surfaces, the peak/valley 100 where the particle is located, conforms to the presence of the particle, and can be deflected by the particle and not make contact with the mating contact 96, as shown in FIG. 13*b*. However, the other peaks/valleys of the conductors 90*a* remain in contact with the mating contact 96, thereby providing an electrical connection between the conductors and the mating contact 96. With this arrangement, very little force may be applied to the particle, and thus when the woven surface of the connector moves with respect to the other surface, the particle does not plow a groove in the other surface, but rather, each contact point of the woven connector may be deflected as it encounters a particle. Thus, the woven connectors may prevent plowing from occurring, thereby reducing wear of the connectors and extending the useful life of the connectors.

Figure 14:
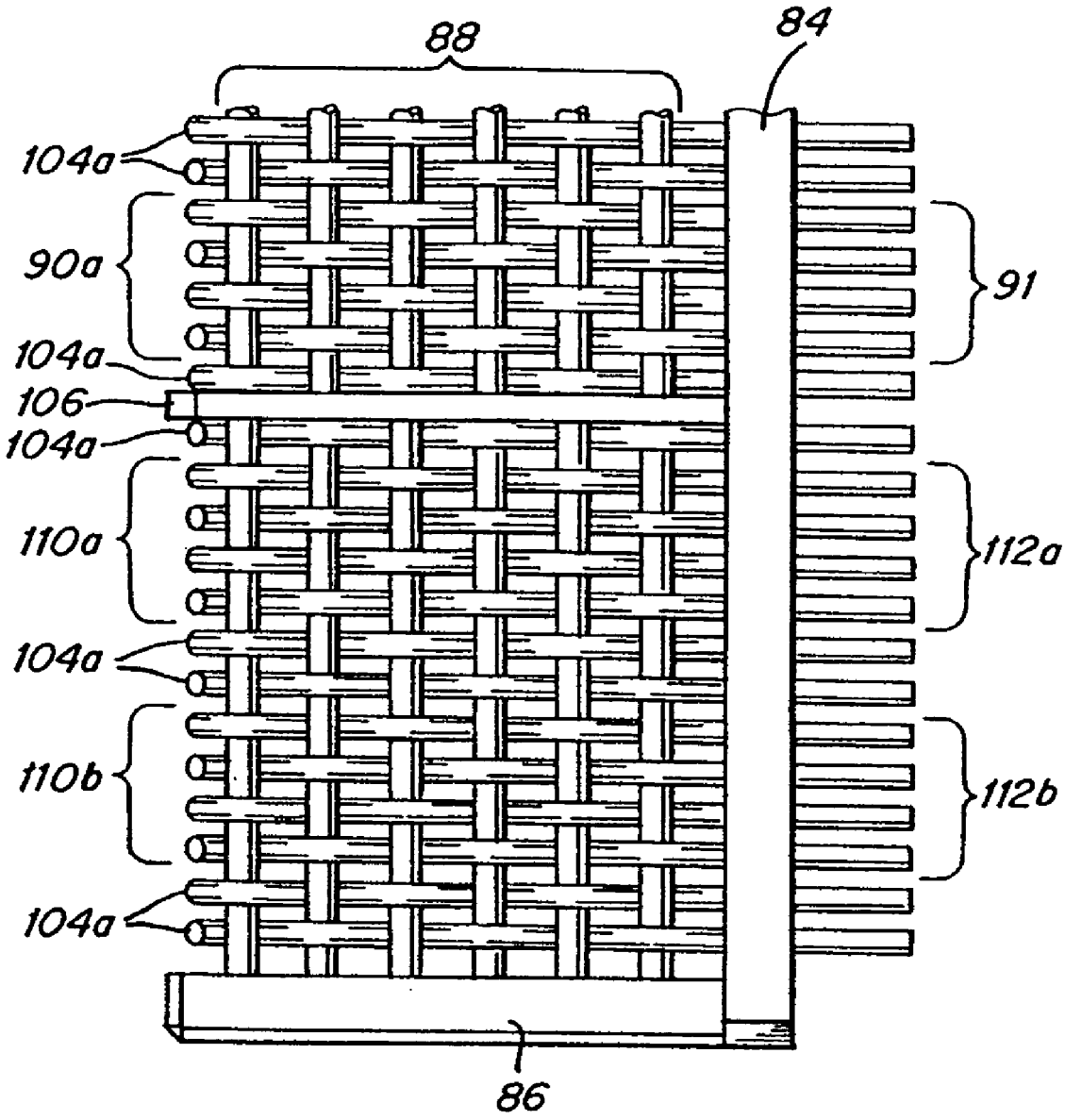
FIG. 14 is plan view of an enlarged portion of the woven connector of FIG. 7.

Referring again to FIG. 7, the connector 80 may further comprise one or more insulating fibers 104 that may be woven with the plurality of non-conductive fibers 88 and may be positioned between sets of conductors that together form an electrical contact. The insulating fibers 104 may serve to electrically isolate one electrical contact from another, preventing the conductors of one electrical contact from coming into contact with the conductors of the other electrical contact and causing an electrical short between the contacts. An enlarged portion of an example of connector 80 is illustrated in FIG. 14. As shown, the connector 80 may include a first plurality of conductors 110*a* and a second plurality of conductors 110*b*, separated by one or more insulating fibers 104*a* and woven with the plurality of non-conductive fibers 88. As discussed above, the first plurality of conductors 110*a* may be connected to a first termination contact 112*a*, forming a first electrical contact. Similarly, the second plurality of conductors 110*b* may be connected to a second termination contact 112*b*, forming a second electrical contact. In one example, the termination contacts 112*a* and 112*b* may together form a differential signal pair of contacts. Alternatively, each termination contact may form a single, separate electrical signal contact. According to another example, the connector 80 may further comprise an electrical shield member 106, that may be positioned, as shown in FIG. 7, to separate differential signal pair contacts from one another. Of course, it is to be appreciated that an electrical shield member may also be included in examples of the connector 80 that do not have differential signal pair contacts.

FIGS. 15*a* and 15*b* illustrate the connector 80 in combination with a mating connector 97. The mating connector 97 may include one or more mating contacts 96 (see FIG. 8), and may also include a mating housing 116 that may have top and bottom plate members 118*a* and 118*b*, seperated by aa spacer 120. The mating contacts 96 may be mounted to the top and/or bottom plate members 118*a* and 118*b*, such that the connector 80 is engaged with the mating connector 97, at least some of the contact points of the plurality of conductors 90 contact the mating contacts 96, providing an electrical connection between the connector 80 and mating connector 97. In one example, the mating contacts 96 may be alternately spaced along the top and bottom plate members 118*a* and 118*b* as illustrated in FIG. 15*a*. The spacer 120 may be connected such that a height of the spacer 120 is substantially equal to or slightly less than a height of the end walls 86 of connector 80, so as to provide an interference fit between the connector 80 and the mating connector 97 and so as to provide contact force between the mating conductors and the contact points of the plurality of conductors 90. In one example, the spacer may be constructed to accomodate movable tensioning end walls 86 of the connector 80, as described above.

It is to be appreciated that the conductors and non-conductive and insulating fibers making up the weave may be extremely thin, for example having diameters in a range of approximately 0.001 inches to approximately 0.020 inches, and thus a very high density connector may be possible using the woven structure. Because the woven conductors are locally compliant, as discussed above, little energy may be expended in overcoming friction, and thus the connector may require only a relatively low normal force to engage a connector with a mating connector element. This may also increase the useful life of the connector as there is a lower possibility of breakage or bending of the conductors occurring when the connector element is engaged with the mating connector element. Pockets or spaces present in the weave as a natural consequence of weaving the conductors and insulating fibers with the non-conductive fibers may also act as particle traps. Unlike conventional particle traps, these particle traps may be present in the weave without any special manufacturing considerations, and do not provide stress features, as do conventional particle traps.

Figure 16A:
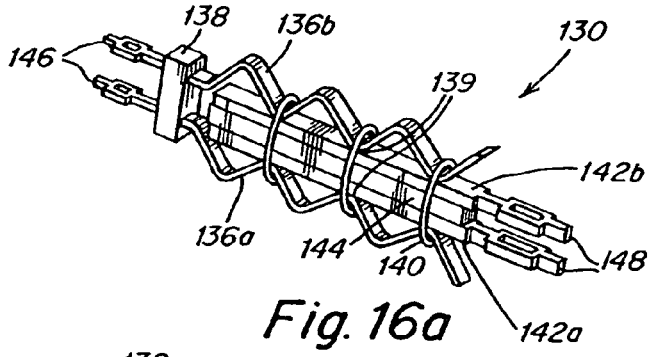
FIG. 16*a* is a perspective view of another embodiment of a connector according to aspects of the present disclosure.
Figure 16B:
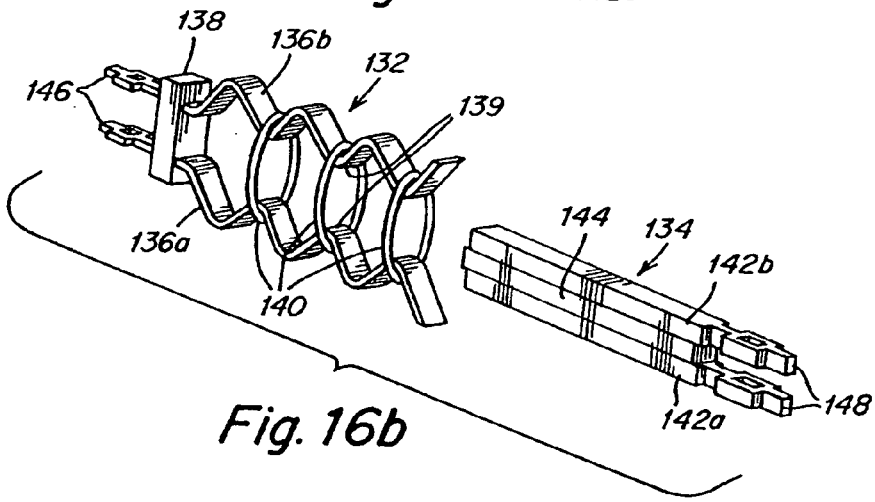
FIG. 16*b* is a perspective view of the connector of FIG. 16 a with mating connector element disengaged.

Referring to FIGS. 16*a* and 16*b*, there is illustrated another embodiment of a woven connector according to aspects of the invention. In this embodiment, a connector 130 may include a first connector element 132 and a mating connector element 134. The first connector element may comprise first and second conductors 136*a* and 136*b* that may be mounted to an insulating housing block 138. It is to be appreciated that although in the illustrated example the first connector element includes two conductors, the invention is not so limited and the first connector element may include more than two conductors. The first and second conductors may have an undulating form along a length of the first and second conductors, as illustrated, so as to include a plurality of contact points 139 along the length of the conductors. In one example of this embodiment, the weave is provided by a plurality of elastic bands 140 that encircle the first and second conductors 136*a* and 136*b*. According to this example, a first elastic band may pass under a first peak of the first conductor 136*a* and over a first valley of the second conductor 136*b*, so as to provide a woven structure having similar advantages and properties to that described with respect to the connector 80 (FIGS. 7–15*b*) above. The elastic bands 140 may include an elastomer, or may be formed of another insulating material. It is also to be appreciated that the bands 140 need not be elastic, and may include an inelastic material. The first and second conductors of the first connector element may be terminated in corresponding first and second termination contacts 146, which may be permanently or removably connected to, for example, a backplane, a circuit board, a semiconductor device, a cable, etc.

As discussed above, the connector 130 may further comprise a mating connector element (rod member) 134, which may comprise third and fourth conductors 142*a*, 142*b* separated by an insulating member 144. When the mating connector element 134 is engaged with the first connector element 132, at least some of the contact points 139 of the first and second conductors may contact the third and fourth conductors, and provide an electrical connection between the first connector element and the mating connector element. Contact force may be provided by the tension in the elastic bands 140. It is to be appreciated that the mating connector element 134 may include additional conductors adapted to contact any additional conductors of the first connector element, and is not limited to having two conductors as illustrated. The mating connector element 134 may similarly include termination contacts 148 that may be permanently or removably connected to, for example, a backplane, a circuit board, a semiconductor device, a cable, etc.

Figure 17A:
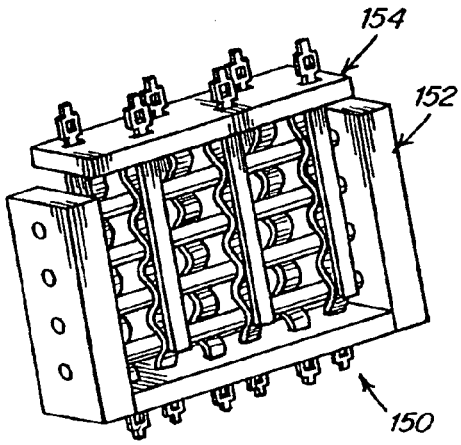
FIG. 17*a* is a perspective view of another embodiment of a connector according to aspects of the present disclosure.
Figure 17B:
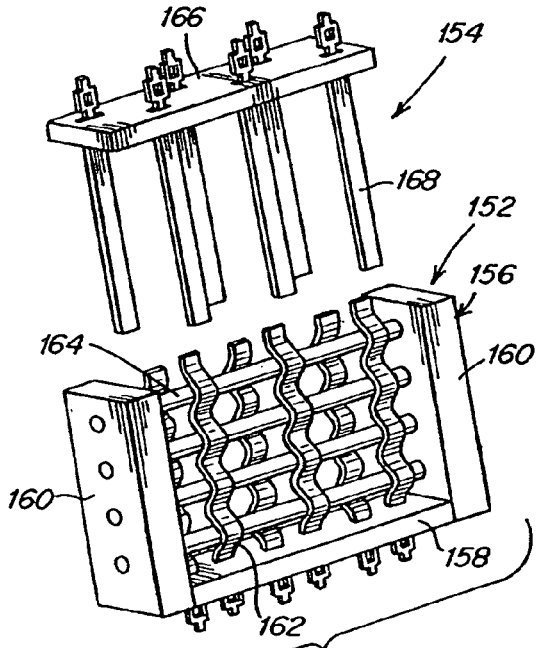
FIG. 17*b* is a perspective view of the connector of FIG. 17*a;*

An example of another woven connector according to aspects of the invention is illustrated in FIGS. 17*a* and 17*b*. In this embodiment, a connector 150 may include a first connector element 152 and a mating connector element 154. The first connector element 152 may comprise a housing 156 that may include a base member 158 and two opposing end walls 160. The first connector element may include a plurality of conductors 162 that may be mounted to the base member and may have an undulating form along a length of the conductors, similar to the conductors 136*a* and 136*b* of connector 130 described above. The undulating form of the conductors may provide a plurality of contact points along the length of the conductors. A plurality of non-conductive fibers 164 may be disposed between the two opposing end walls 160 and woven with the plurality of conductors 162, forming a woven connector structure. The mating connector element 154 may include a plurality of conductors 168 mounted to an insulating block 166. When the mating connector element 154 is engaged with the first connector element 152, as illustrated in FIG. 17*a*, at least some of the plurality of contact points along the lengths of the plurality of conductors of the first connector element may contact the conductors of the mating connector element to provide an electrical connection therebetween. In one example, the plurality of non-conductive fibers 164 may be elastic and may provide a contact force between the conductors of the first connector element and the mating connector element, as described above with reference to FIGS. 9*a* and 9*b*. Furthermore, the connector 150 may include any of the other tensioning structures described above with reference to FIGS. 10*a*–12. This connector 150 may also have the advantages described above with respect to other embodiments of woven connectors. In particular, connector 150 may prevent trapped particles from plowing the surfaces of the conductors in the same manner described in reference to FIG. 13.

Figure 18:
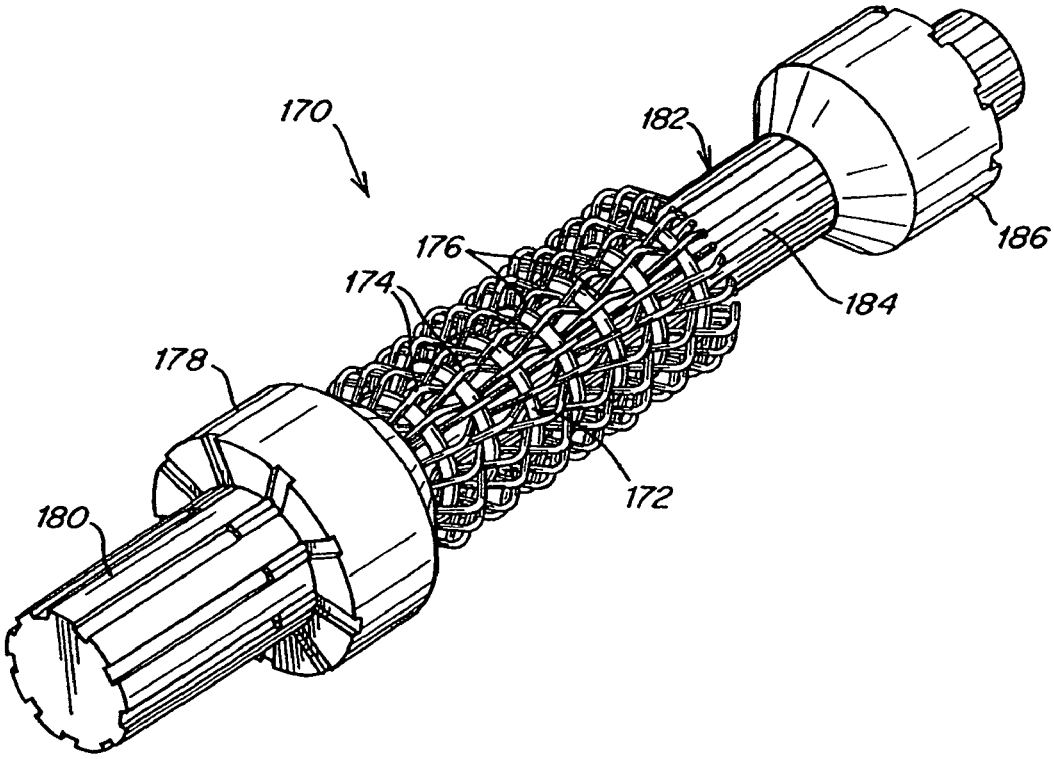
FIG. 18 is a perspective view of another embodiment of a woven connector according to aspects of the present disclosure.

Referring to FIG. 18, there is illustrated yet another embodiment of a woven connector according to the invention. The connector 170 may include a woven structure including a plurality of non-conductive fibers (bands) 172 and at least one conductor 174 woven with the plurality of non-conductive fibers 172. In one example, the connector may include a plurality of conductors 174, some of which may be separated from one another by one or more insulating fibers 176. The one or more conductors 174 may be woven with the plurality of non-conductive fibers 172 so as to form a plurality of peaks and valleys along a length of the conductors, thereby providing a plurality of contact points along the length of the conductors. The woven structure may be in the form of a tube, as illustrated, with one end of the weave connected to a housing member 178. However, it is to be appreciated that the woven structure is not limited to tubes, and may have any shape as desired. The housing member 178 may include a termination contact 180 that may be permanently or removably connected to, for example, a circuit board, backplane, semiconductor device, cable, etc. It is to be appreciated that the termination contact 180 need not be round as illustrated, but may have any shape suitable for connection to devices in the application in which the connector is to be used.

The connector 170 may further include a mating connector element (rod member) 182 to be engaged with the woven tube. The mating connector element 182 may have a circular cross-section, as illustrated, but it is to be appreciated that the mating connector element need not be round, and may have another shape as desired. The mating connector element 182 may comprise one or more conductors 184 that may be spaced apart circumferentially along the mating connector element 182 and may extend along a length of the mating connector element 182. When the mating connector element 182 is inserted into the woven tube, the conductors 174 of the weave may come into contact with the conductors 184 of the mating connector element 182, thereby providing an electrical connection between the conductors of the weave and the mating connector element. According to one example, the mating connector element 182 and/or the woven tune may include registration features (not illustrated) so as to align the mating connector element 182 with the woven tube upon insertion.

Figure 19:
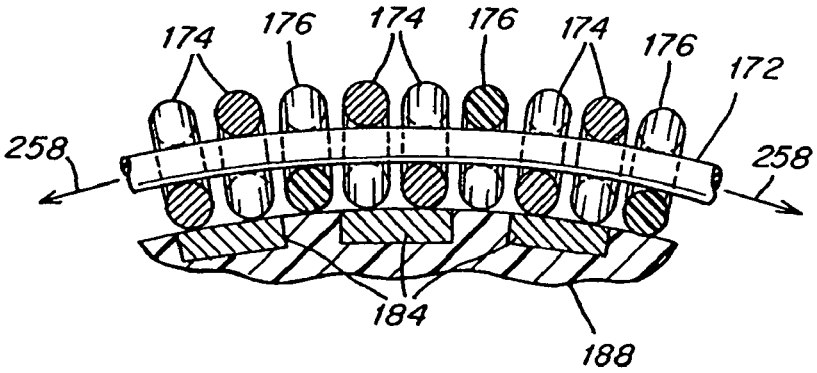
FIG. 19 is an enlarged cross-sectional view of a portion of the connector of FIG. 18.

In one example, the non-conductive fibers 172 may be elastic and may have a circumference substantially equal to or slightly smaller than a circumference of the mating connector element 182 so as to provide an interference fit between the mating connector element and the woven tube. Referring to FIG. 19, there is illustrated an enlarged cross-sectional view of a portion of the connector 170, illustrating that the nonconductive fibers 172 may be tensioned in directions of arrows 258. The tensioned nonconductive fibers 172 may provide contact force that causes at least some of the plurality of contact points along the length of the conductors 174 of the weave to contact the conductors 184 of the mating connector element. In another example, the non-conductive fibers 172 may be inelastic and may include spring members (not shown), such that the spring members allow the circumference of the tube to expand when the mating connector element 182 is inserted. The spring members may thus provide the elastic/tension force in the woven tube which in turn may provide contact force between at least some of the plurality of contact points and the conductors 184 of the mating connector element 182.

As discussed above, the weave is locally compliant, and may also include spaces or pockets between weave fibers that may act as particle traps. Furthermore, one or more conductors 174 of the weave may be grouped together (in the illustrated example of FIGS. 18 and 19, the conductors 174 are grouped in pairs) to provide a single electrical contact. Grouping the conductors may further improve the reliability of the connector by providing more contact points per electrical contact, thereby decreasing the overall contact resistance and also providing capability for complying with several particles without affecting the electrical connection.

Figure 20A:
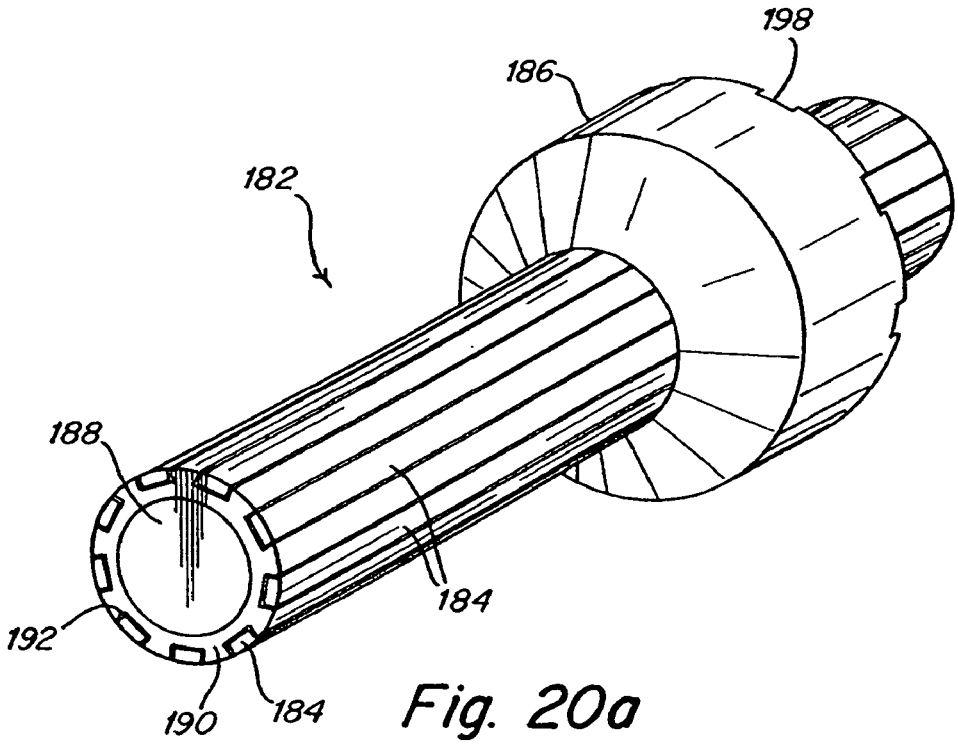
FIG. 20*a* is a perspective view of an example of a mating connector element.
Figure 20B:
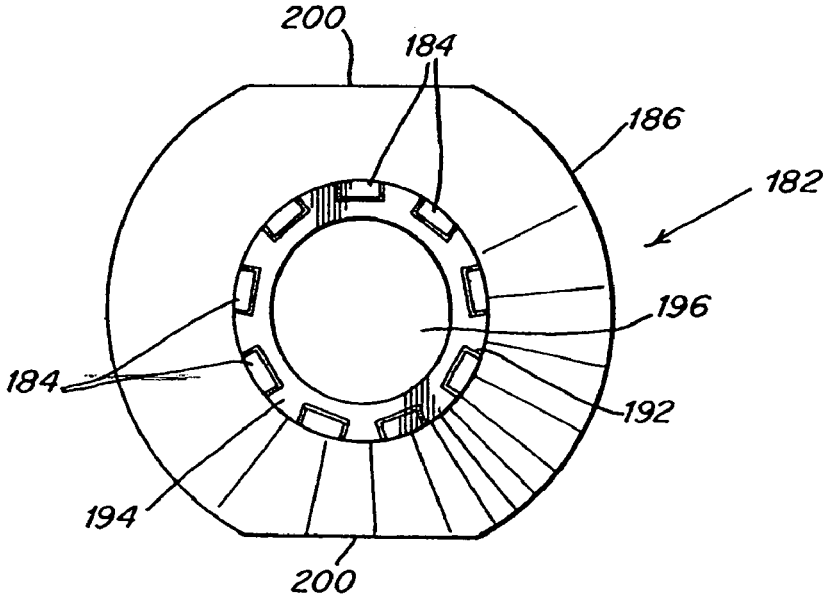
FIG. 20*b* is a cross-sectional view of another example of a the mating connector element.

Referring to FIGS. 20*a* and 20*b*, there are illustrated in perspective view and cross-section, respectively, two examples of a mating connector element 182 that may be used with the connector 170. According to one example, illustrated in FIG. 20*a*, the mating connector element 182 may include a dielectric or other non-conducting core 188 surrounded, or at least partially surrounded, by a conductive layer 190. The conductors 184 may be separated from the conductive layer 190 by insulating members 192. The insulating members may be separate for each conductor 184 as illustrated, or may comprise an insulating layer at least partially surrounding the conductive layer 190. The mating connector element may further include an insulating housing block 186.

According to another example, illustrated in FIG. 20*b*, a mating connector element 182 may comprise a conductive core 194 that may define a cavity 196 therein. Any one or more of an optical fiber, a strength member to increase the overall strength and durability of the rod member, and a heat transfer member that may serve to dissipate heat built up in the connector from the electrical signals propagating in the conductors, may be located within the cavity 196. In one example, a drain wire may be located within the cavity and may be connected to the conductive core to serve as a grounding wire for the connector. As illustrated in FIG. 20*a*, the housing block 186 may be round, increasing the circumference of the mating connector element, and may include one or more notches 198 that may serve as registration points for the connector to assist in aligning the mating connector element with the conductors of the woven tube. Alternatively, the housing block may include flattened portions 200, as illustrated in FIG. 20*b*, that may serve as registration guides. It is further to be appreciated that the housing block may have another shape, as desired and may include any form of registration known to, or developed by, one of skill in the art.

Figure 21:
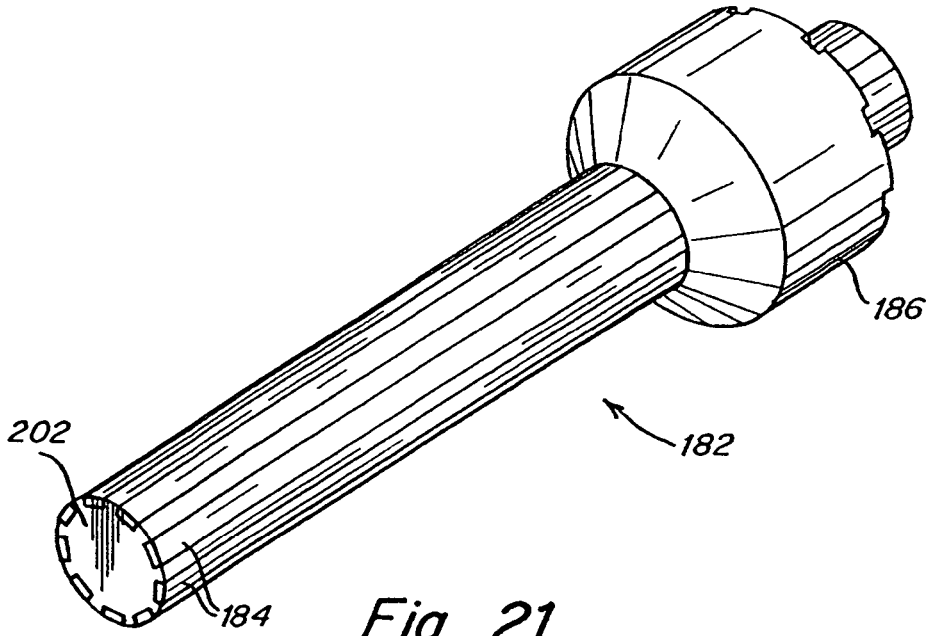
FIG. 21 is a perspective view of another example of a mating connector element that may form part of the connector of FIG. 18.

FIG. 21 illustrates yet another example of a mating connector element 182 that may be used with the connector 170. In this example, the mating connector element may include a dielectric or other non-conducting core 202 that may be formed with one or more grooves, to allow the conductors 184 to be formed therein, such that a top surface of the conductors 184 is substantially flush with an outer surface of the mating connector element.

Figure 22:
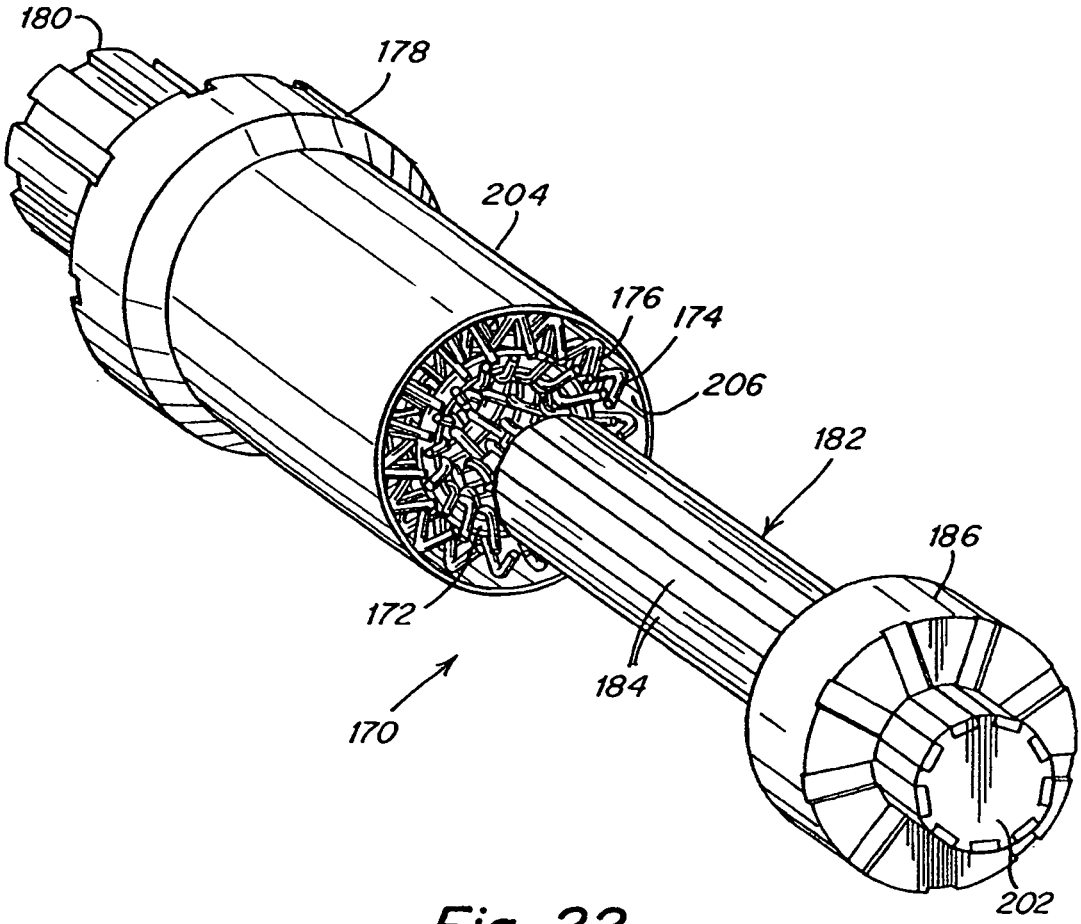
FIG. 22 is a perspective view of another example of a mating connector element, including a shield, that may form part of the connector of FIG. 18.

According to another example, illustrated in FIG. 22, the connector 170 may further comprise an electrical shield 204 that may be placed substantially surrounding the woven tube. The shield may comprise an non-conducting inner layer 206 that may prevent the conductors 174 from contacting the shield and thus being shorted together. In one example, the rod member may comprise a drain wire located within a cavity of the mating connector element, as discussed above, and the drain wire may be electrically connected to the electrical shield 204. The shield 204 may comprise, for example, a foil, a metallic braid, or another type of shield construction known to those of skill in the art.

Figure 23:
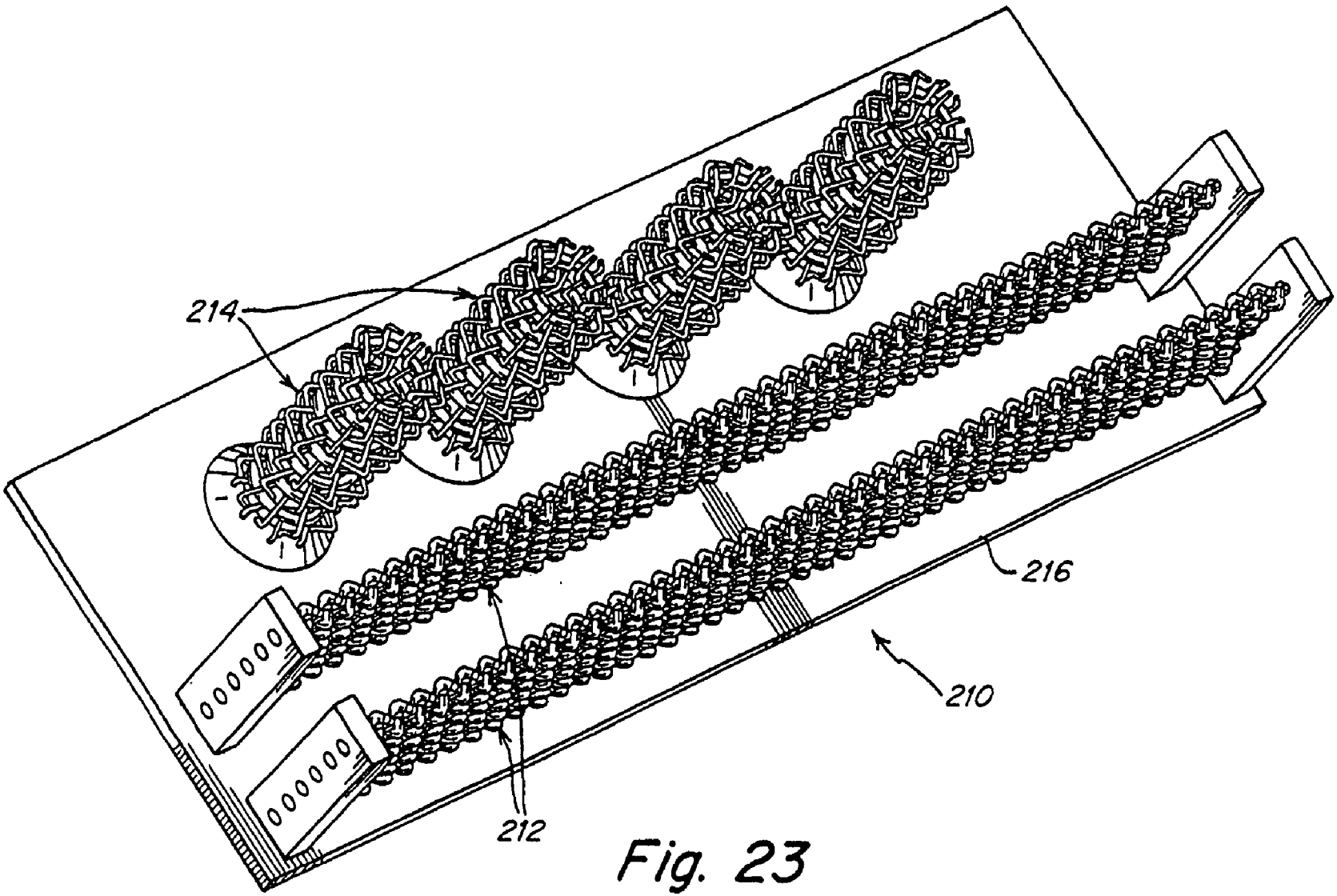
FIG. 23 is a perspective view of an array of woven connectors according to aspects of present disclosure.

Referring to FIG. 23, there is illustrated an example of an array of woven connectors according to aspects of the invention. According to one embodiment, the array 210 may comprise one or more woven connectors 212 of a first type, and one or more woven connectors 214 of a second type. In one example, the woven connectors 212 may be the connector 80 described above in reference to FIGS. 7–15*b*, and may be used to connect signal traces and or components on different circuit boards to one another. The woven connectors 214 may be the connector 170 described above in reference to FIGS. 18–22, and may be used to connect power traces or components on the different circuit boards to one another. In one example where the connector 170 may be used to provide power supply connections, the rod member 180 may be substantially completely conductive. Furthermore, in this example, there may be no need to include insulating fibers 176, and the fibers 172, previously described as being non-conductive, may in fact be conductive so as to provide a larger electrical path between the woven tube and the rod member. The connectors may be mounted to a board 216, as illustrated, which may be, for example, a backplane, a circuit board, etc., which may include electrical traces and components mounted to a reverse side, or positioned between the connectors (not shown).

As discussed herein, the utilization of conductors being woven or intertwined with loading fibers, e.g., non-conductive fibers, can provide particular advantages for electrical connector systems. Designers are constantly struggling to develop (1) smaller electrical connectors and (2) electrical connectors which have minimal electrical resistance. The woven connectors described herein can provide advantages in both of these areas. The total electrical resistance of an assembled electrical connector is generally a function of the electrical resistance properties of the male-side of the connector, the electrical resistance properties of the female-side of the connector, and the electrical resistance of the interface that lies between these two sides of the connector. The electrical resistance properties of both the male and female-sides of the electrical connector are generally dependent upon the physical geometries and material properties of their respective electrical conductors. The electrical resistance of a male-side connector, for example, is typically a function of its conductor's (or conductors') cross-sectional area, length and material properties. The physical geometries and material selections of these conductors are often dictated by the load capabilities of the electrical connector, size constraints, structural and environmental considerations, and manufacturing capabilities.

Figure 24:
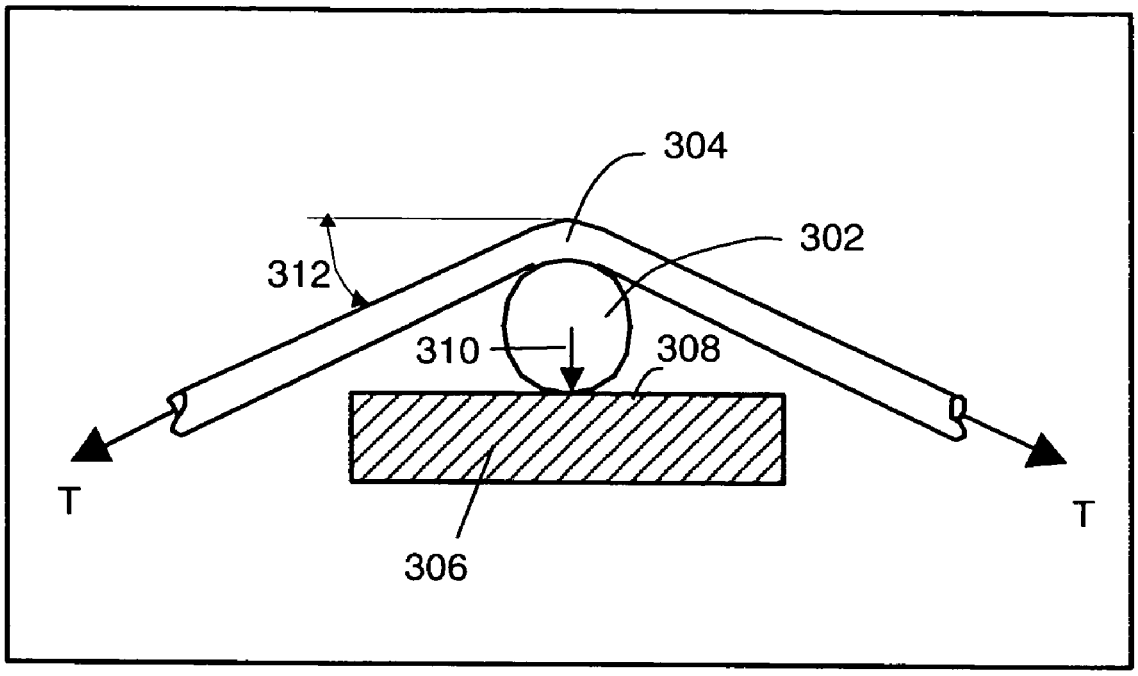
FIG. 24 is a cross-sectional view of an exemplary woven connector embodiment that illustrates the orientation of a conductor and a loading fiber.
Figure 25A:
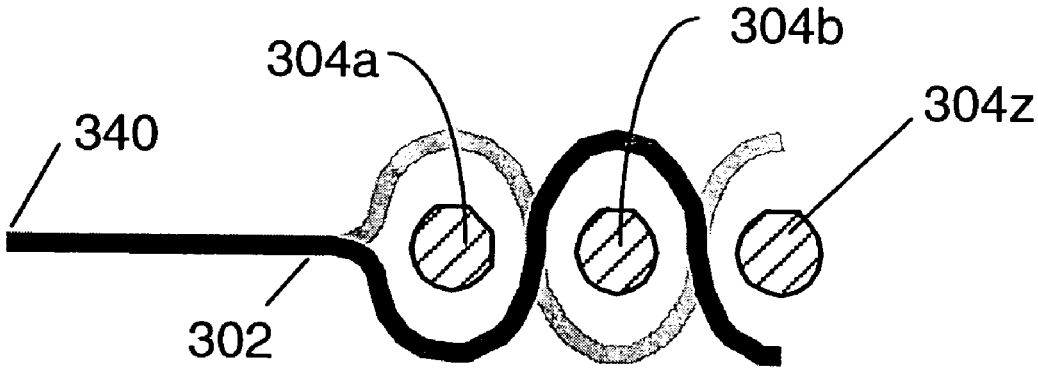
FIGS. 25*a–b* illustrate conductor woven connector embodiments.
Figure 25B:
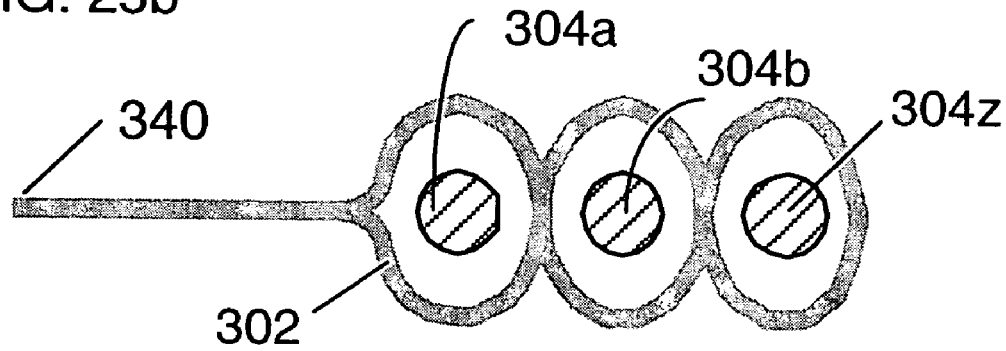

Another critical parameter of an electrical connector is to achieve a low and stable separable electrical resistance interface, i.e., electrical contact resistance. The electrical contact resistance between a conductor and a mating conductor in certain loading regions can be a function of the normal contact force that is being exerted between the two conductive surfaces. As can be seen in FIG. 24, the normal contact force 310 of a woven connector is a function of the tension T exerted by the loading fiber 304, the angle 312 that is formed between the loading fiber 304 and the contact mating surface 308 of the mating conductor 306, and the number of conductors 302 of which the tension T is acting upon. As the tension T and/or angle 312 increase, the normal contact force 310 also increases. Moreover, for a desired normal contact force 310 there may be a wide variety of tension T/angle 312 combinations that can produce the desired normal contact force 310. FIGS. 25*a–b* illustrate a method for terminating the conductors 302 that are woven onto loading fibers 304. Referring to FIG. 25*a*, conductor 302 winds around a first loading fiber 304*a*, a second loading fiber 304*b* and a last loading fiber 304*z*. The orientation and/or pattern of the conductor 302-loading fiber 304 weave can vary in other embodiments, e.g., a valley formed by a conductor 302 may encompass more than one loading fiber 304, etc. The conductors 302 on one side terminate at a termination point 340. Termination point 340 will generally comprise a termination contact, as previously discussed. In an exemplary embodiment, the conductors 302 may also terminate on the opposite side of the weave at another termination point (not shown) that, unlike termination point 340, will generally not comprise a termination contact. FIG. 25*b* illustrates a preferred embodiment for weaving the conductors 302 onto the loading fibers 304*a–z*. In FIG. 25*b*, the conductor 302 is woven around the first and second loading fibers 304*a*, 304*b* in the same manner as discussed above. In this preferred embodiment, however, conductor 302 then wraps around the last loading fiber 304*z* and is then woven around the second loading fiber 304*b* and then the first loading fiber 304*a*. Thus, the conductor 302 begins at termination point 340, is woven around the conductors 304*a*, 304*b*, wrapped around loading fiber 304*z*, woven (again) around loading fibers 304*b*, 304*a*, and terminates at termination point 340. Having a conductor 302 wrap around the last loading fiber 304*z* and becoming the next conductor (thread) in the weave eliminates the need for a second termination point. Consequently, when a conductor 302 is wrapped around the last loading fiber 304*z* in this manner the conductor 302 is referred to as being self-terminating.

Figure 26A:
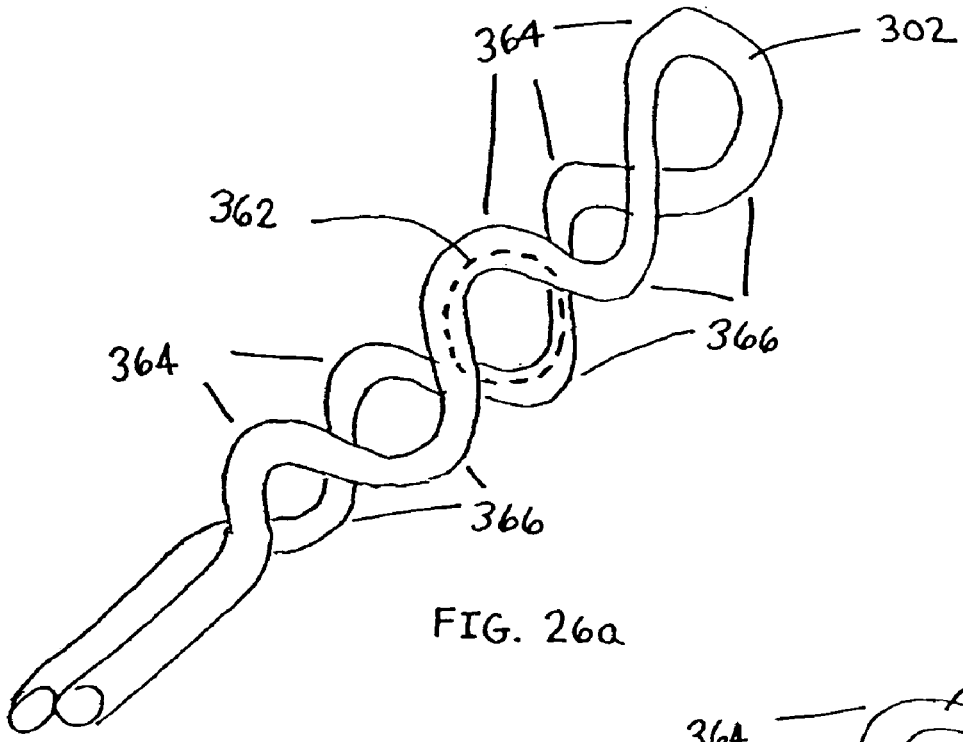
FIG. 26*a–c* illustrate woven connector embodiments having self-terminating conductors.
Figure 26B:
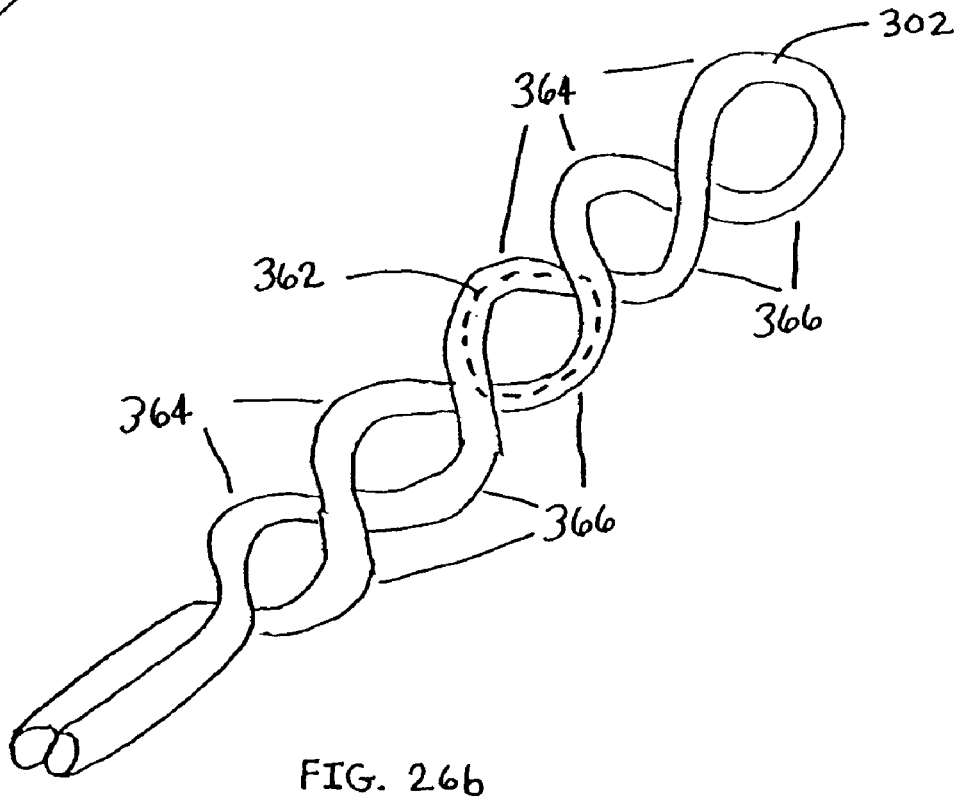
Figure 26C:
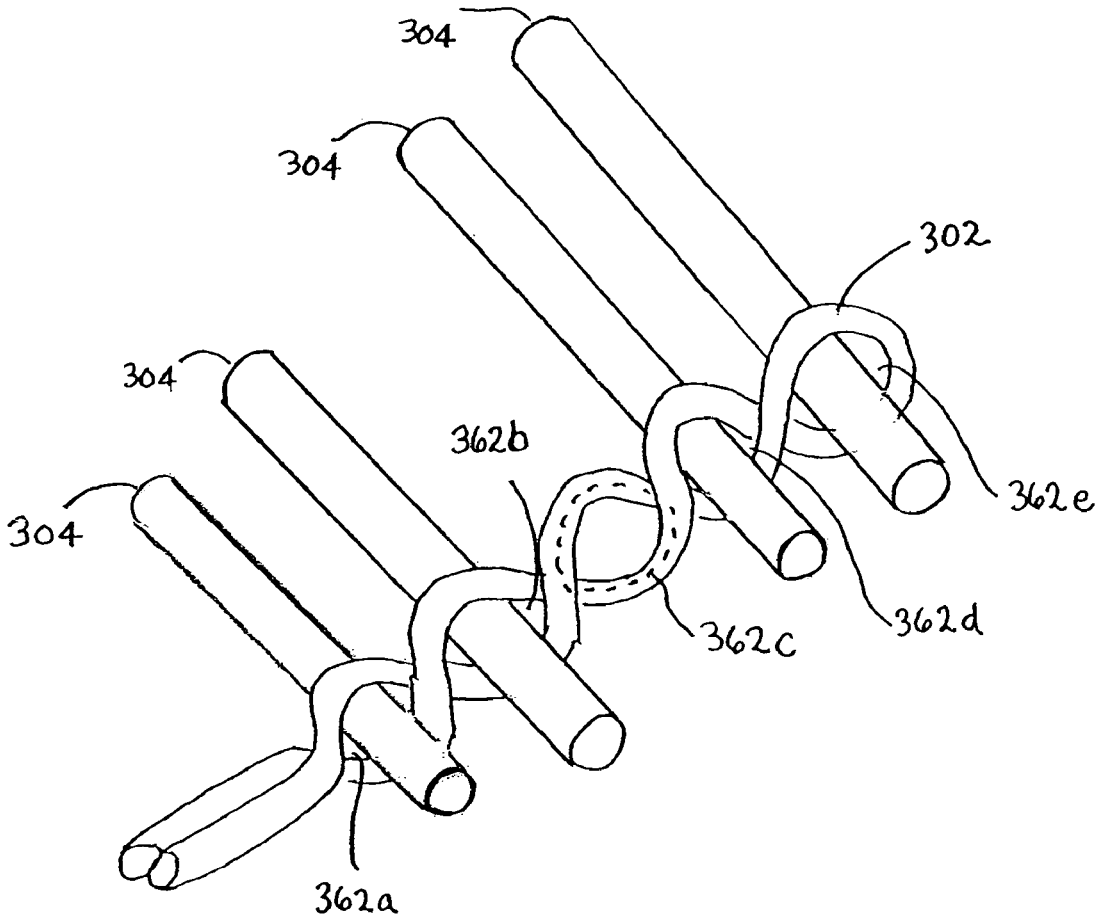

FIGS. 26*a–c* illustrate some exemplary embodiments of how conductor(s) 302 can be woven onto loading fibers 304. The conductor 302 of FIGS. 26*a–c* is self-terminating and, while only one conductor 302 is shown, persons skilled in the art will readily appreciate that additional conductors 302 will usually be present within the depicted embodiments. FIG. 26*a* illustrates a conductor 302 that is arranged as a straight weave. The conductor 302 forms a first set of peaks 364 and valleys 366, wraps back upon itself (i.e., is self-terminated) and then forms a second set of peaks 364 and valleys 366 that lie adjacent to and are offset from the first set of peaks 364 and valleys 366. A peak 364 from the first set and a valley 366 from the second set (or, alternatively, a valley 366 from the first set and a peak 364 from the second set) together can form a loop 362. Loading fibers 304 can be located within (i.e., be engaged with) the loops 362. While the conductor 302 of FIGS. 26*a–c* is shown as being self-terminating, in other exemplary embodiments, the conductors 302 need not be self-terminating. Using non self-terminating conductors 302, to form a straight weave similar to the one disclosed in FIG. 26*a*, a first conductor 302 forms a first set of peaks 364 and valleys 366 while a second conductor 302 forms a second set of peaks 364 and valleys 366 which lie adjacent to and are offset from the first set. The loops 363 are similarly formed from corresponding peaks 364 and valleys 366. FIG. 26*b* illustrates a conductor 302 that is arranged as a crossed weave. The conductor 302 of FIG. 26*b* forms a first set of peaks 364 and valleys 366, wraps back upon itself and then forms a second set of peaks 364 and valleys 366 which are interwoven with, and are offset from, the first set of peaks 364 and valleys 366. Similarly, peaks 364 from the first set and valleys 366 from the second set (or, alternatively, valleys 366 from the first set and peaks 364 from the second set) together can form loops 362, which may be occupied by loading fibers 304. Non self-terminating conductors 302 may also be arranged as a crossed weave.

FIG. 26*c* depicts a self-terminating conductor 302 that is cross woven onto four loading fibers 304. The conductor 302 of FIG. 26*c* forms five loops 362*a–e*. In certain exemplary embodiments, a loading fiber(s) 304 is located within each of the loops 362 that are formed by the conductors 302. However, not all loops 362 need to be occupied by a loading fiber 304. FIG. 26*c*, for example, illustrates an exemplary embodiment where loop 362*c* does not contain a loading fiber 304. It may be desirable to include unoccupied loops 362 within certain conductor 302-loading fiber 304 weave embodiments so as to achieve a desired overall weave stiffness (and flexibility). Having unoccupied loops 362 within the weave may also provide improved operations and manufacturing benefits. When the weave structure is mounted to a base, for example, there may be a slight misalignment of the weave relative to the mating conductor. This misalignment may be compensated for due to the presence of the unoccupied loop 362. Thus, by utilizing loops that are unoccupied or "unstitched", i.e., a loading fiber 304 does not contact the loop, compliance of the weave structure to ensure better conductor/mating conductor conductivity while keeping the weave tension to a minimum may be achieved. Utilizing unoccupied loops 362 may also permit greater tolerance allowances during the assembly process. Moreover, the use of unstitched loops 362 may allow the use of common tooling for different connector embodiments (e.g., the same tooling might be used for a weave 8 having eight loops 362 with six "stitched" loading fibers 304 as for a weave having eight loops 362 with eight loading fibers 304. As an alternative to using an unstitched loop 362, a straight (unwoven) conductor 302 may be used instead.

Figure 27:
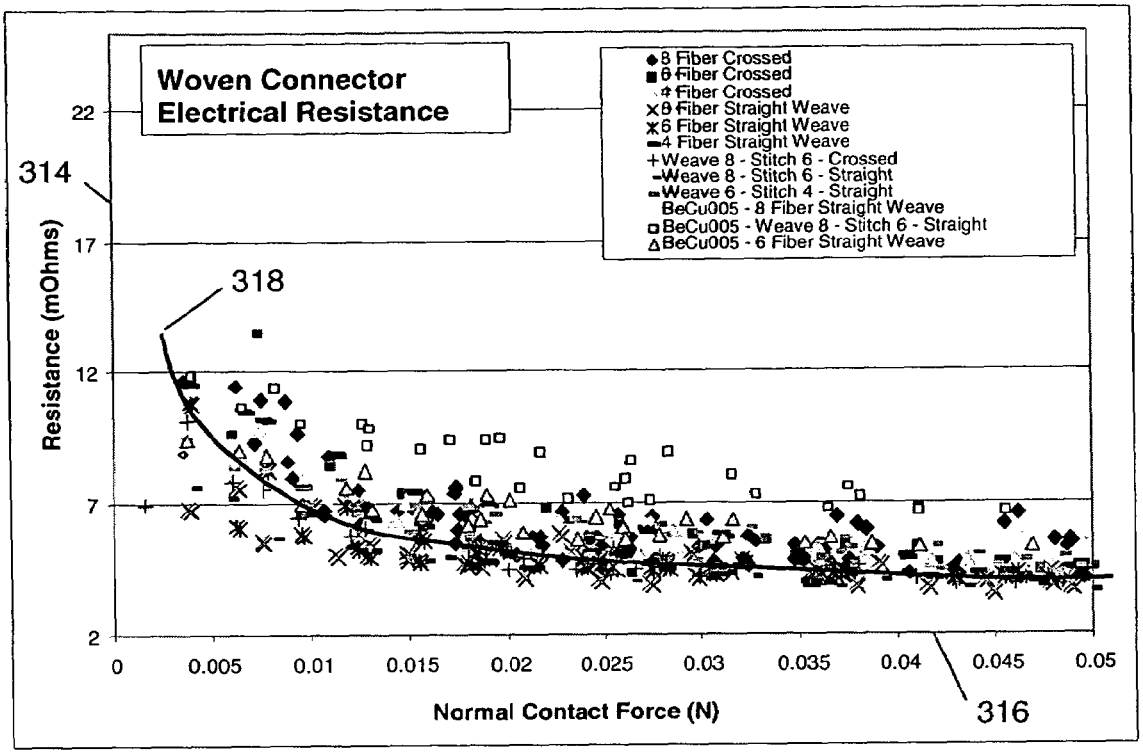
FIG. 27 illustrates the electrical resistance versus normal contact force relationship of several different woven connector embodiments.

Tests of a wide variety of conductor 302-loading fiber 304 weave geometries were performed to determine the relationship between normal contact force 310 and electrical contact resistance. Referring to FIG. 27, the total electrical resistance of the tested woven connector embodiments, as represented on y-axis 314, of the different woven connector embodiments (as listed in the legend) was determined over a range of normal contact forces, as represented on x-axis 316. As represented in FIG. 27, the general trend 318 indicates that as the normal contact force (in Newtons (N)) increases, the contact resistance component of the total electrical resistance (in milli-ohms (mOhms)) generally decreases. Persons skilled in the art will readily recognize, however, that the decrease in contact resistance only extends over a certain range of normal contact forces; any further increases over a threshold normal contact force will produce no further reduction in electrical contact resistance. In other words, trend 318 tends to flatten out as one moves further and further along the x-axis 316.

From the data of FIG. 27, for example, one can then determine a normal contact force (or range thereof) that is sufficient for minimizing a woven connector's electrical contact resistance. To generate these normal contact forces, the preferred operating range of the tension T to be loaded in the loading fiber(s) 304 and the angle 312 (which is indicative of the orientation of the loading fiber(s) 304 relative to the conductor(s) 302) can then be determined for an identified woven connector embodiment. As persons skilled in the art will readily appreciate, the vast majority of the conventional electrical connectors that are available today operate with normal contact forces ranging from about 0.35 to 0.5 N or higher. As is evident by the data represented in FIG. 27, by generating multiple contact points on conductors 302 of a woven connector system, very light loading levels (i.e., normal contact forces) can be used to produce very low and repeatable electrical contact resistances. The data of FIG. 27, for example, demonstrates that for many of the woven connector embodiments tested, normal contact forces of between approximately 0.020 and 0.045 N may be sufficient for minimizing electrical contact resistance. Such normal contact forces thus represent an order of magnitude reduction in the normal contact forces of conventional electrical connectors.

Recognizing that very low normal contact forces can be utilized in these woven multi-contact connectors, the challenge then becomes how to generate these normal contact forces reliably at each of the conductor 302's contact points. The contact points of a conductor 302 are the locations where electrical conductivity is to be established between the conductor 302 and a contact mating surface 308 of a mating conductor 306. FIGS. 28*a* and 28*b* depict an exemplary embodiment of a woven multi-contact connector 400 that is capable of generating desired normal contact forces at each of the contact points. FIGS. 26*a* and 26*b* depict cross-sectional views of a woven connector 400 having a woven connector element 410 and a mating connector element 420. The woven connector element 410 is comprised of loading fiber(s) 304 and conductors 302. The ends of the loading fibers(s) 304 generally are secured to end plates (not shown) or other fixed structures, as further described below. The loading fiber(s) 304 may be in an unloaded (non-tensioned) or loaded condition prior to the woven connector element 410 being engaged with the mating connector element 420. While only one loading fiber 304 is shown in these cross-sectional views, it should be recognized that additional loading fibers 304 are preferably located behind (or in front of) the depicted loading fiber 304. Woven connector element 410 has three bundles, or arrays, of conductors 302 woven around each loading fiber 304. The hidden-line portions of conductors 302 reflect where the woven conductors' 302 peaks and valleys are out of plane with the particular cross-section shown. Generally, a second loading fiber 304 (not shown) would be utilized in conjunction with these out-of-plane peaks and valleys. Although not shown here, conductors 302 can be placed directly against adjacent conductors 302 so that electrical conductivity between adjacent conductors 302 can be established.

FIG. 28*b* depicts the woven connector element 410 of FIG. 28*a* after being engaged with the mating connector element 420. To engage the woven connector element 410, the woven connector element 410 is inserted into cavity 422 of mating connector element 420. In certain embodiments, a front face (not shown) of the mating conductors 306 may be chambered to better accommodate the insertion of the woven connector element 410. Upon insertion into the mating connector element 420, the loading fibers 304 are displaced to accommodate the profile of the cavity 422 and the presence of the mating conductors 306. In some embodiments, the displacement of the loading fibers 304 can be facilitated through a stretching of the loading fibers 304. In other embodiments, this displacement can be accommodated through the tightening of an otherwise slack (in a pre-engaged condition) loading fiber 304 or, alternatively, a combination of stretching and tightening, which results in a tension T being present in the loading fibers 304. As previously discussed, due to the orientation and arrangement of the loading fibers 304-conductors 302 weave, the tension T in the loading fibers 304 will cause certain normal contact forces to be present at the contact points. As can be seen in FIG. 28*b*, the woven connector 400 has mating conductors 306 that are alternately located on the interior surfaces (which define the cavity 422) of the mating connector element 420. This alternating contact arrangement produces alternating contacts on opposite parallel planar contact mating surfaces 308.

Instead of utilizing a flat (e.g., substantially planar) contact mating surface 308 as depicted in FIG. 28*b*, another embodiment uses a curved, e.g., convex, contact mating surface 308. The curvature of the contact mating surface 308 may permit improved tolerance controls for contact between the contact points of the conductors 302 and the mating conductors 306 in the normal direction. The curved surface (of the contact mating surfaces 308) helps maintain a very tightly controlled normal force between these two separable contact surfaces. The curved surface itself, however, does not generally assist in maintaining lateral alignment between the conductors 302 and the mating conductors 306. Insulating fibers (e.g., insulating fibers 104 as shown in FIG. 7) placed parallel with and interspersed between segments of conductors 302 could be utilized to assist with the lateral alignment of adjacent conductors 302. The curvature of the contact mating surface 308 need not be that significant; improved location tolerances can be realized with a relatively small amount of curvature. In some preferred embodiments, contact mating surfaces 308 having a large radius of curvature may be used to achieve some desired manufacturing location tolerances. FIG. 29 illustrates an alternative mating conductor 306 having a curved contact mating surface 308 that could be used in the woven connector 400 of FIG. 28. The curvature of the contact mating surface 308 allows for a very generous positioning tolerance during manufacturing and operation.

Referring to FIG. 29, improved location tolerances can often be achieved by utilizing contact mating surfaces 308 which have a radius of curvature R 336 that is greater than the width W 309 of the mating conductor 306. Specifically, the relationship between the lateral spacing L 332 found between two conductors 302 and the angle $\alpha$ 334 between the two conductors 302 and the radius of curvature R 336 of the contact mating surface 308 is given by the formula $L \approx \alpha R$. The minimum of the lateral spacing L 332 is set by the diameter of the conductors 302 and, thus, the lateral spacing L 332 may be tightly controlled by locating the conductors 302 directly against each other. In other words, in certain exemplary embodiments the conductors 302 are located so that no gap exists between the adjacent conductors 302. Thus, for a very low angle $\alpha$ 334, the required radius of curvature R 336 can then be determined. In an exemplary embodiment having an angle $\alpha$ 334 of 0.25 degrees and conductors 302 having a diameter of 0.005 inches, for example, a preferred contact mating surface's 308 radius of curvature R 336 would thus be on the order of about 2.29 inches. The tolerance on this is also quite generous as the angle $\alpha$ 334 is directly related to the radius of curvature R 336. For example, if the tolerance on the radius of curvature R 336 was set at ±0.10 inches, then the angle $\alpha$ 334 could vary from between 0.261 degrees and 0.239 degrees. To illustrate the benefits of using a curved contact mating surface 308, to maintain a tolerance of 0.03 degrees on the flat array embodiment of FIG. 28 would require a tolerance of 0.0000105 inches on the offset height H 324. Additionally, the introduction of curved contact mating surfaces 308 does not materially affect the overall height of the woven connectors. With a radius of curvature R 336 of 2.29 inches and a mating conductor 306 width W 309 of 0.50 inches, for example, the total height 311 of the arc would only be about 0.014 inches, i.e., the contact mating surface 308 is nearly flat.

In most exemplary embodiments, the conductors 302 of a connector will generally have similar geometries, electrical properties and electrical path lengths. In some embodiments, however, the conductors 302 of a connector may have dissimilar geometries, electrical properties and/or electrical path lengths. Additionally, in some preferred power connector embodiments, each conductor 302 of a connector is in electrical contact with the adjacent conductor(s) 302. Providing multiple contact points along each conductor 302 and establishing electrical contact between adjacent conductors 302 further ensures that the multi-contact woven power connector embodiments are sufficiently load balanced. Moreover, the geometry and design of the woven connector prohibit a single point interface failure. If the conductors 302 located adjacent to a first conductor 302 are in electrical contact with mating conductors 306, then the first conductor 302 will not cause a failure (despite the fact that the contact points of the first conductor 302 may not be in contact with a mating conductor 306) since the load in the first conductor 302 can be delivered to a mating conductor 306 via the adjacent conductors 302.

In certain exemplary embodiments, the conductors 302 can be comprised of copper or copper alloy (e.g., C110 copper, C172 Beryllium Copper alloy) wires having diameters between 0.0002 and 0.010 inches or more. Alternatively, the conductors may also be comprised of copper or copper alloy flat ribbon wires having comparable rectangular cross-section dimensions. The conductors 302 may also be plated to prevent or minimize oxidation, e.g., nickel plated or gold plated. Acceptable conductors 302 for a given woven connector embodiment should be identified based upon the desired load capabilities of the intended connector, the mechanical strength of the candidate conductor 302, the manufacturing issues that might arise if the candidate conductor 302 is used and other system requirements, e.g., the desired tension T.

In exemplary embodiments, the loading fibers 304 may be comprised of nylon, fluorocarbon, polyaramids and paraaramids (e.g., Kevlar®, Spectra®, Vectran®), polyamids, conductive metals and natural fibers, such as cotton, for example. In most exemplary embodiments, the loading fibers 304 have diameters (or widths) of about 0.010 to 0.002 inches. However, in certain embodiments, the diameter/widths of the loading fibers 304 may be as low as 18 microns when high performance engineered fibers (e.g., Kevlar) are used. In a preferred embodiment, the loading fibers 304 are comprised of a non-conducting material.

Figure 30:
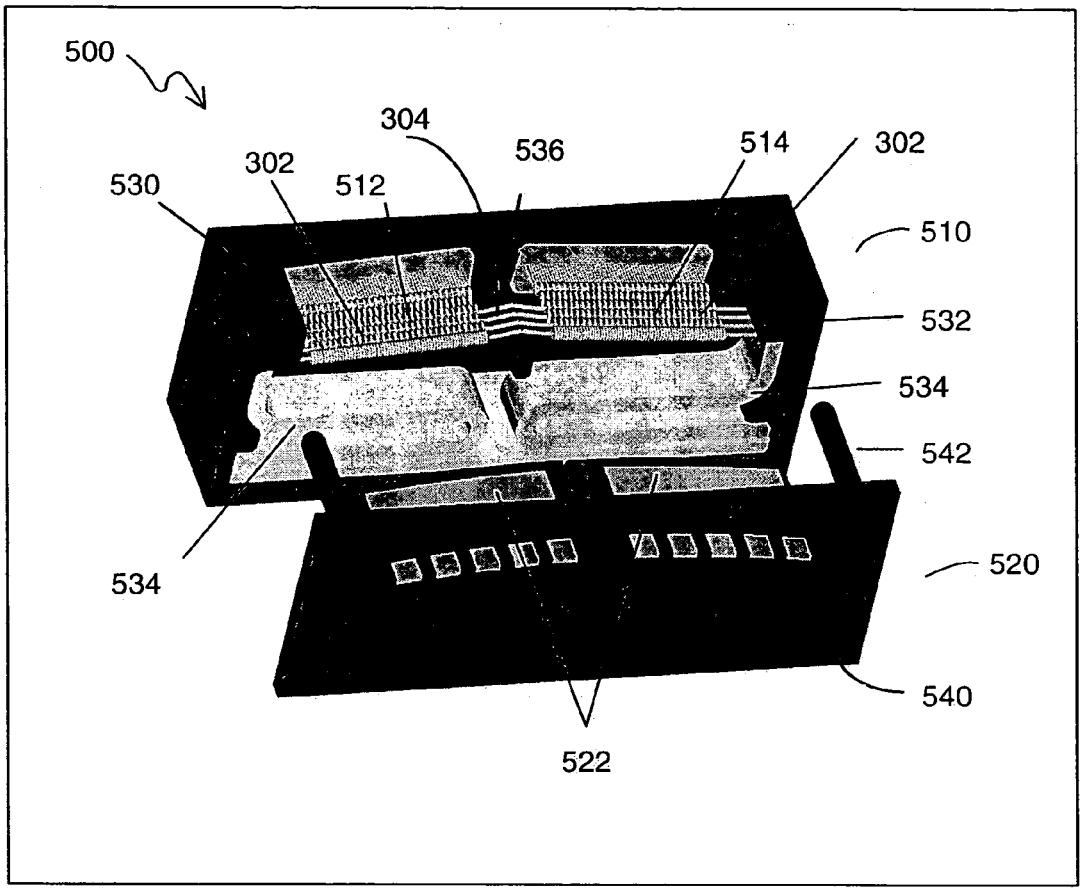
FIG. 30 depicts another exemplary embodiment of a woven power connector in accordance with the teachings of the present disclosure.

FIG. 30 illustrates another exemplary embodiment of a multi-contact woven power connector 500 that is highly balanced. The power connector 500 consists of two extended arrays, a power array 512 and a return array 514. These arrays provide multiple contact points over a wide area, which can result in high redundancy, lower separable electrical contact resistance, and better thermal dissipation of parasitic electrical losses. The power connector 500 could be a 30 amp DC connector. The power connector 500 is comprised of a woven connector element 510 and a mating connector element 520. The woven connector element 510 is comprised of a housing 530, a power circuit 512, a return circuit 514, two spring mounts 534, a guide member 536 and several loading fibers 304. The housing 530 has several holes 532 which can accommodate the alignment pins 542 of the mating connector element 520. The power circuit 512 is comprised of several conductors 302 woven around several loading fibers 304 in accordance with the teachings of the present disclosure. In a preferred embodiment, these conductors 302 are arranged to be self-terminating. The conductors 302 of the power circuit 512 exit a back portion of the housing 530 and may form a termination point where power can be delivered to the power connector 500. As is discussed in more detail below, the loading fibers 304 of the power circuit 512 (and return circuit 514) are capable of carrying a tension T that ultimately translates into a contact normal force being asserted at the contact points of the conductors 302. The return circuit 514 is arranged in the same manner as the power circuit 512. The loading fibers 304 of the power connector 500 are comprised of a non-conducting material, which may or may not be elastic. The guide member 536 is mounted to an inside wall of the housing 530 and is positioned so as to provide structural support for the loading fibers 304 and, indirectly, the power circuit 512 and return circuit 514. The ends of the loading fibers 304 are secured to the spring mounts 534. As is described in greater detail below, the spring mounts 534 are capable of generating a tensile load T in the attached loading fibers 304 of the woven connector element 510.

The mating connector element 520 of the power connector 500 consists of a housing 540, two mating conductors 522 and alignment pins 542. The mating conductors 522 are secured to an inside wall of the housing 540 such that when the mating connector element 520 is engaged with the woven connector element 510, the contact points of the conductors 302 (of circuits 512 and 514) will come into electrical contact with the mating conductors 522. Alignment pins 542 are aligned with the holes 532 of the woven connector element 510 and thus assist in facilitating the coupling of the mating connector element 520 to the woven connector element 510 (or vice versa).

Figure 31:
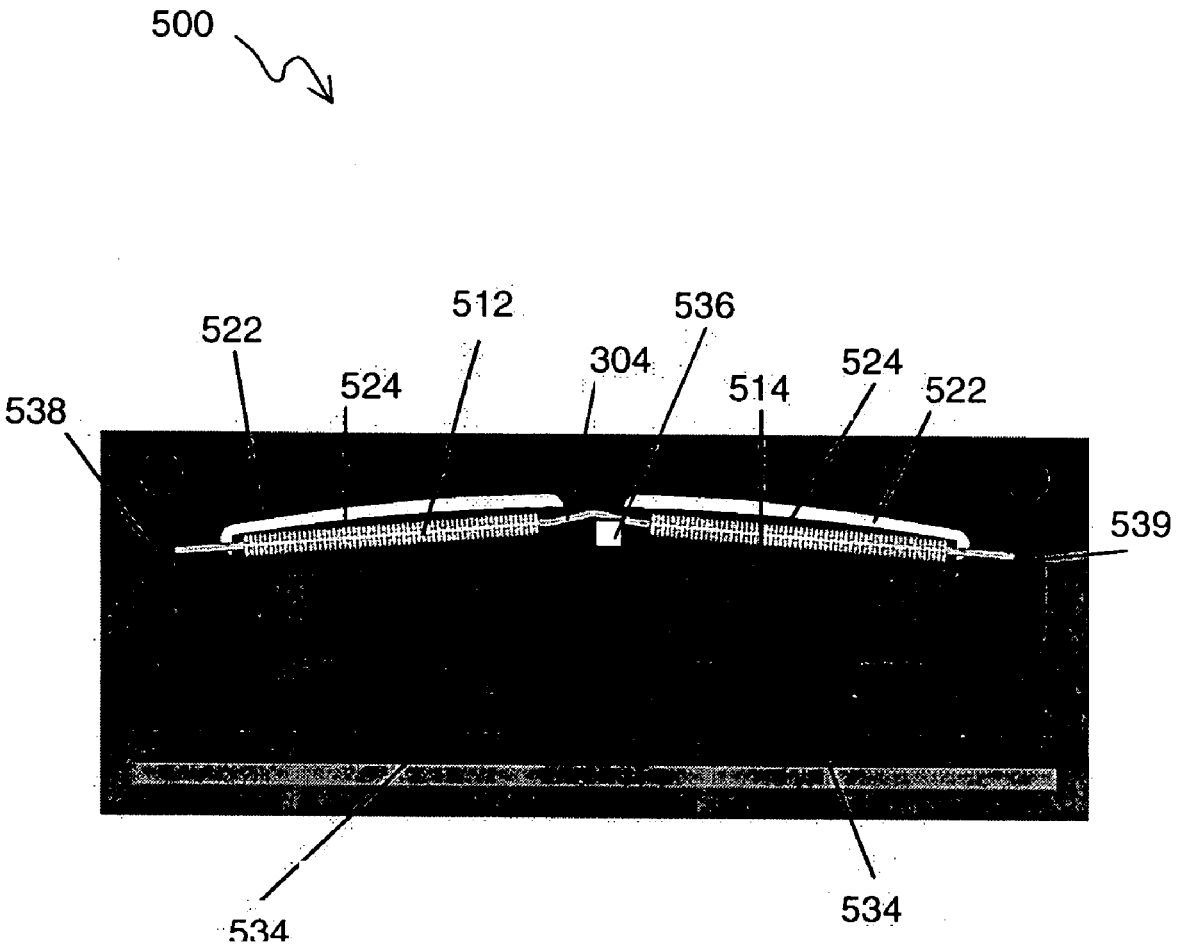
FIG. 31 depicts a side view of the connector of FIG. 30.

Power connector 500 uses pre-tensioned spring mounts 534 to generate and maintain the required normal contact force between the contact points of the conductors 302 (of the circuits 512, 514) and the mating conductors 522. FIG. 31 depicts the power connector 500 after the mating connector element 520 has been engaged with the woven connector element 510. After engagement, the contact points of the conductors 302 of both the power circuit 512 and return circuit 514 are in electrical contact with the contact mating surfaces 524 of the mating conductors 522.

In a preferred embodiment, the contact mating surfaces 524 are convex surfaces that are defined by a radius of curvature R. As shown in FIG. 31, the convex contact mating surfaces 524 are located on a bottom side of the mating conductors 522, i.e., after engagement, the conductors 302 are located below the mating conductors 522. In an exemplary embodiment, the guide member 536 is positioned such that the upper potion of the guide member 536 is located above the contact mating surfaces 524. After engagement, the loading fibers 304 run from an end 538 of the first spring mount 534, against the convex contact mating surface 524 that corresponds to the power circuit 512, over the top portion of the guide member 536, against the convex contact mating surface 524 that corresponds to the return circuit 512 and then terminates at an end 539 of the second spring mount 534. In other exemplary embodiments, the contact mating surfaces 524 can be located on the top-side of the mating conductors 522, and the loading fibers 304 would therefore extend over these top-located convex contact mating surfaces 524. The locations of the end 538, guide member 536, contact mating surfaces 524 and end 539, working in conjunction with the tension T generated in the loading fibers 304, facilitate the delivery of the contact normal forces at the contact points of the conductors 302.

Figure 32A:
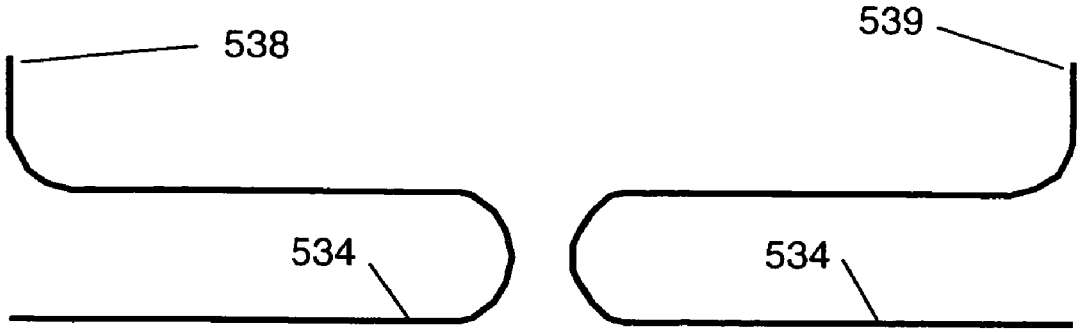
FIG. 32*a–c* depict various positions of the spring mounts that are provided in the woven connector embodiment of FIG. 30.
Figure 32B:
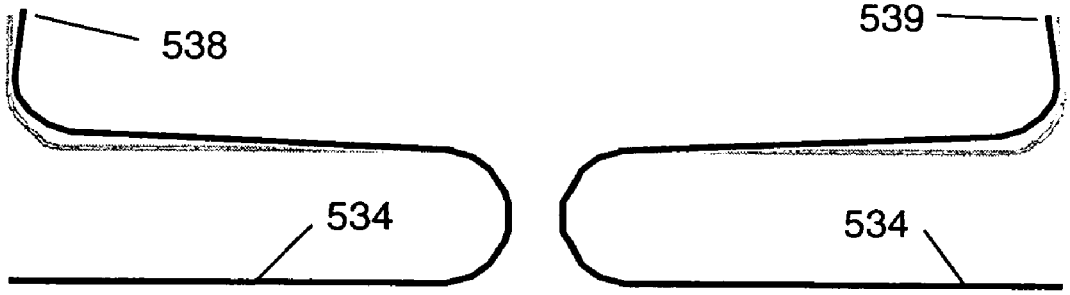
Figure 32C:
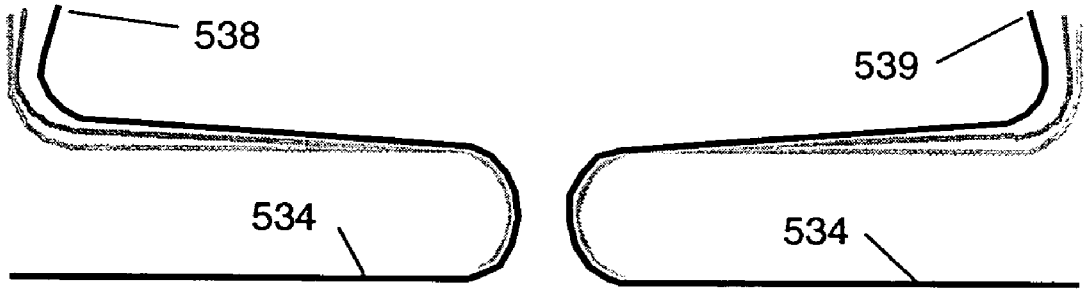

FIGS. 32*a–c* depict an exemplary embodiment of a pair of spring mounts 534 that could be used in power connector 500. The loading fibers 304 have been omitted for clarity but it should be understood that the ends of the loading fibers 304 are to be attached to the ends 538, 539. Prior to engagement, the loading fibers 304 are supported by a support pin (not shown), such as the guide member 536, for example. During engagement, the loading fibers 304 are aligned with contact mating surfaces 524. FIGS. 32*a–c* illustrate how the spring mounts 538 function in the power connector 500. FIG. 32*a* illustrates the spring mounts 534 in an un-loaded state that occurs prior to the loading fibers being coupled to the ends 538, 539. Referring to FIG. 32*b*, to attach the loading fibers 304 to the ends 538, 539, the ends 538, 539 are slightly moved inward and the loading fibers 304 are then anchored to the ends 538, 539. Persons skilled in the art will readily recognize a wide variety of ways in which the loading fibers 304 can be anchored to the ends 538, 539, e.g., using slots, anchor points, fasteners, clamps, welding, brazing, bonding, etc. After the loading fibers 304 have been anchored to the ends 538, 539 of the spring mounts 534, a small tension force will generally be present in the loading fibers 304. Referring now to FIG. 32*c*, during the insertion of the mating connector element 520 into the woven connector element 510, the loading fibers 304 are pushed under the contact mating surfaces 524 (or, alternatively, pulled over the contact mating surfaces 524, if the surfaces 524 are located on the top side of the mating conductors 522) and the mating of the power connector 500 is then completed. To facilitate the engagement of the loading fibers 304 with the contact mating surfaces 524, the ends 538, 539 of the spring mounts 534 will generally undergo some additional deflection. Thus, the loading fibers 304 will be subjected to an additional tensile load so that a resultant tension T is then present in the loading fibers 304 (and, consequently, contact normal forces are present at the contact points of the conductors 302).

The electrical connectors constructed in accordance with the teachings of the present disclosure are inherently redundant. If any of the loading fibers 304 of these embodiments breaks or looses tension, the remaining loading fibers 304 could be able to continue to assert sufficient tension T so that electrical contact at the contact points of the conductors 302 could be maintained and, thus, the connectors could continue to carry the rated current capacity. In certain exemplary embodiments, a complete failure of all the loading fibers 304 would have to occur for the connector to loose electrical contact. In the case of dirt or a contaminant in the system, the multiple contact points are much more efficient at maintaining contact than a traditional one or two contact point connector. If a single point failure does occur (due to dirt or mechanical failure), then there are generally at least three surrounding local contact points which would be capable of handling the diverted current: the next contact point found in line (or previous in line) on the same conductor 302, and since each conductor 302 is preferably in electrical contact with the conductors 302 that are adjacent to it, the current can also flow into these adjacent conductors 302 and then through the contact points of these conductors 302.

The woven conductor arrangements that are described above in regards to electrical connectors can also be utilized in a wide variety of woven multi-contact electrical switch embodiments. A switch can be thought of as an electrical power connector that has to frequently make and break contact on an energized circuit. Therefore, the characteristics that characterize a power connector, such as contact resistance and contact wear, can also be applied to switches. [The contact resistance is the electrical resistance between two or more separable contact points.] It is preferable to keep the contact resistances as low as possible because then resistance losses in the form of heat (i.e., $I^2R$ ) are minimized. Thus, generally the less a switch heats up, the more current it can carry.

A conductor 302 provides multiple points of contact on the switch contact. Particulate matter (dirt, dust, corrosion products etc.) on the surface of the contact does not pose a threat to the electrical contact created as a result of the 'local compliance' (as described in detail above) and multiple contact points of the woven switch technology. With this approach, very little force is applied to a particle that is trapped between two switch contact surfaces, and when the surface of the woven conductor-loading fiber weave moves with respect to the other surface, the particle does not plow a groove in the other surface, but rather, each contact point of the woven conductor may be deflected as it encounters a particle. Thus, the woven connectors may prevent plowing from occurring, thereby reducing wear of the switches and extending the useful life of the switches. The use of multiple contact points also significantly reduces the risk of complete circuit separation due to the presence of particulate matter and dirt.

Figure 33:
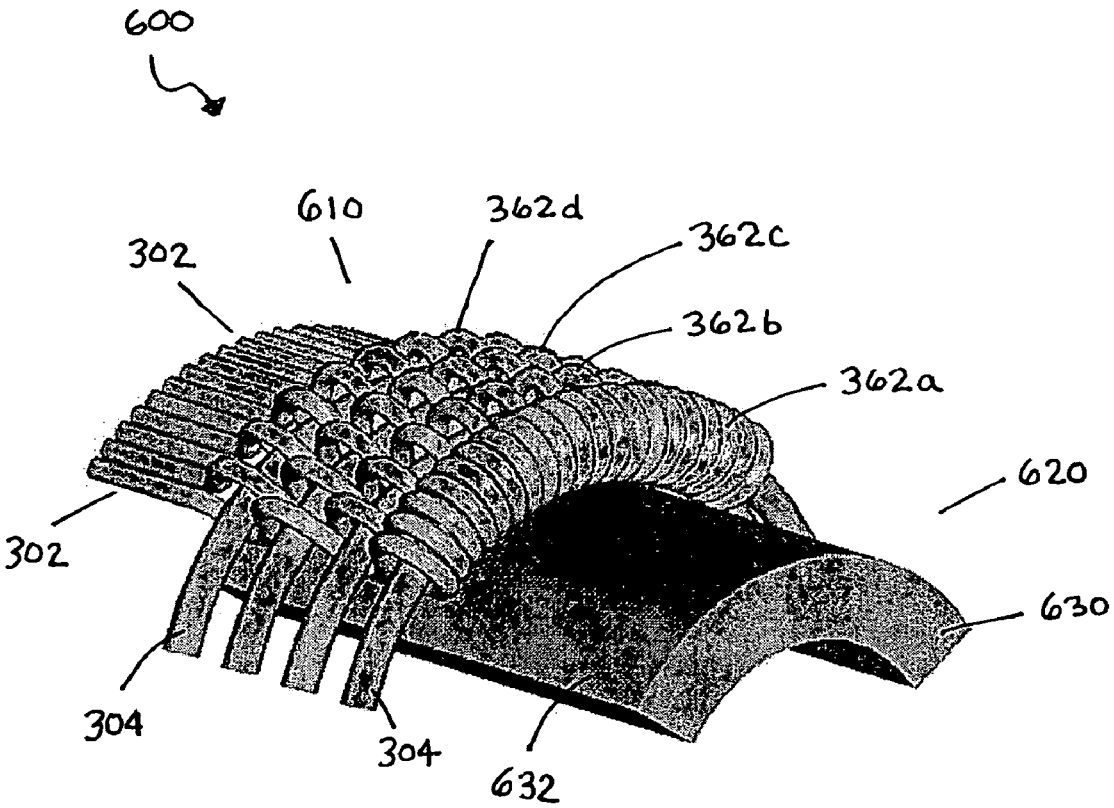
FIG. 33 depicts an exemplary embodiment of a woven multi-contact switch in accordance with the teachings of the present disclosure.

FIG. 33 depicts a partial view of a multi-contact woven electrical switch 600 constructed in accordance with the present invention. Referring to FIG. 33, switch 600 consists of a woven switch element 610 and a mating switch element 620. The woven switch element 610 includes a plurality of conductors 302 that are woven onto four loading fibers 304. The mating switch element 620 includes a mating conductor 630 having a contact mating surface 632. To engage the switch 600, the woven switch element 610 is moved laterally towards the mating switch element 620 so that the conductors 302 come into contact with the contact mating surface 632 of the mating conductor 630. To disengaged the switch 600, the woven switch element 610 is moved laterally away from the mating switch element 620 so that the contact between the conductors 302 and contact mating surface 632 of the mating conductor 630 is broken. The conductors 302 are woven onto the loading fibers 304 such that the loading fibers 304 generate appropriate normal forces at the switch contact point, i.e., normal contact forces are generated at the contact points of the conductors 302 so that the conductors 302 contact the curved contact mating surface 632 of the mating conductor 630 when the woven switch element 610 is engaged with the mating switch element 620. The conductors 302 are woven to form four series of loops (or rows), loops 362*a–d*, where each series of loops is formed around a single loading fiber 304. While the described switch 600 contains four loops, other embodiments can include more or fewer loops.

When a switch opens and/or closes (i.e., is engaged and/or is disengaged), arcing can occur. The energy of the arc is a complex dynamic function that can have serious consequences for the switch. The energy depends on whether the source is AC or DC, the voltage magnitude and frequency, the circuit type (e.g., resistive, capacitive, inductive) and the environmental conditions (e.g., humidity, fungus, temperature, pressure).

The following is a brief discussion of an arcing phenomena that commonly occurs in switches. Imagine a switch opening in slow motion. At the very last microscopic point of contact the current density becomes large enough to cause melting of the contact asperities. This liquid metal (plasma) continues to conduct current as the switch contacts physically separate. This plasma collides with air molecules (assuming the switch is in air), causing them to ionize. This breakdown is what is commonly referred to as an "arc." The voltage drop across the arc is proportional to the arc length. In other words, the further the contacts move apart, the larger the voltage drop. In DC circuits, this voltage drop soon matches the battery supply voltage. When this occurs, the current is driven to zero and the circuit is open. In this way, the arc is useful. However, arcs (depending on their energy levels) can cause the metallic contacts to carbonize and deteriorate. This can eventually lead to higher contact resistances and shorter switch life. It also introduces carbon particles that can increase wear and lead to failure. With respect to AC current, there is no need to drive the arc voltage to the same value as the source voltage because the current alternates about zero. Since a zero current occurs twice in each AC cycle, in an AC switch, an arc thus will not exist for longer than half a cycle.

Another important feature is the type of circuit where the switch is used. In a purely resistive DC circuit, the arc time is generally short and the arc energy is generally low. When opening a switch in DC inductive circuits, however, generally the arcing is more severe because the energy stored in the circuit magnetic field dissipates in the arc. When closing a switch in a DC capacitive circuit, the in-rush current can lead to high arcing levels and contact erosion.

Figure 34A:
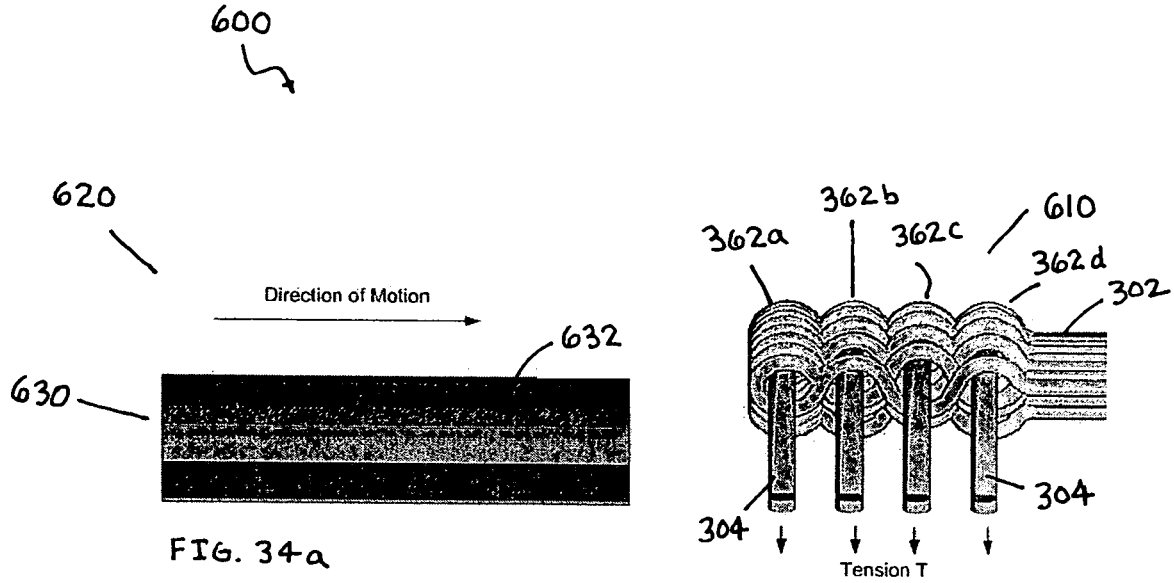
FIGS. 34*a–c* depict an exemplary embodiment of a woven multi-contact switch element being engaged with a contact mating surface of a mating conductor.
Figure 34B:
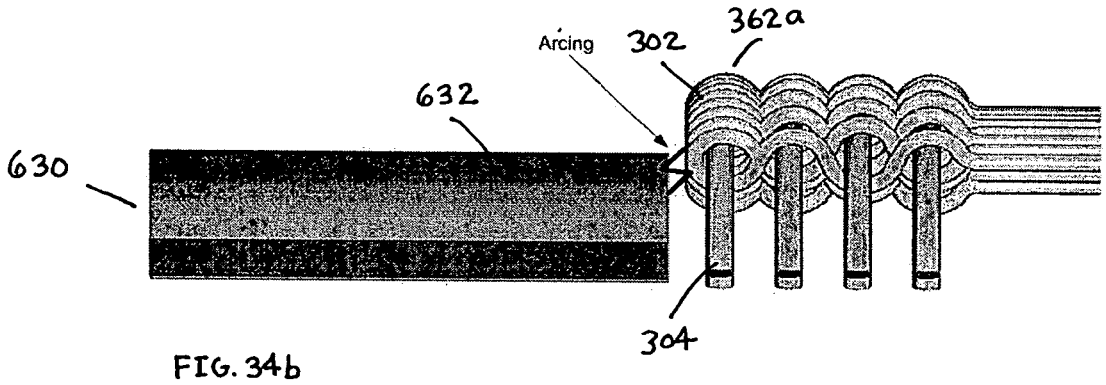
Figure 34C:
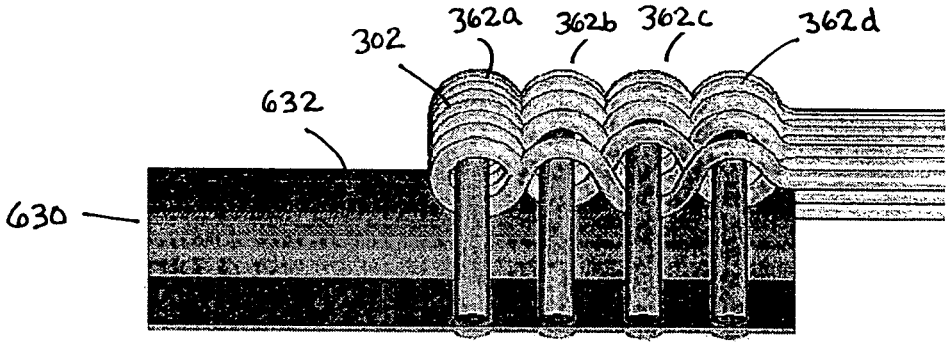

The woven multi-contact switch technology described herein offers unique advantages for switches: the inventive weave's multiple contact points and large level of redundancy can be used to minimize the effect of arcing. FIGS. 34*a–c* illustrate the arcing that would be expected in switch 600 as the mating switch element 620 is engaged with the woven switch element 610. FIG. 34*a* shows the switch 600 in its open, disengaged position. FIG. 34*b* shows switch 600 as the contact mating surface 632 of the mating conductor 630 is about to make contact with the conductors 302. FIG. 34*c* shows the switch 600 in its closed, engaged position, i.e., when the contact points of the conductors 302 are in contact with the contact mating surface 632. As previously discussed, the conductors 302 of switch 600 are arranged so as to form four series of loops 362*a–d*. As is shown in FIG. 34*b*, as the first series of loops 362*a* comes in close proximity to the contact mating surface 632 of the mating conductor 630 (e.g., a pin) an arc is formed between the contact mating surface 632 and the first series of loops 362*a*. When the first series of loops 362*a* then makes physical contact with the contact mating surface 632, the arc extinguishes and the current flows between the woven switch element 610 and the mating switch element 620. Referring now to FIG. 34*c*, as the mating switch element 620 is moved further towards the woven switch element 610 (or vice versa), the series of loops 362*b–d* then come into physical contact with the contact mating surface 632 of the mating conductor 630.

In the fully-engaged, steady state condition (FIG. 34*c*) the current will flow through the switch 600 via the path of least resistance. For example, if the contact mating surface 632 of the mating conductor 630 has lower electrical resistance than the conductors 302 of the weave, then the majority of the current will flow through the fourth series of loops, loops 362*d*, into the contact mating surface 632. Of course slight resistance irregularities, particle contamination and different tensions in the loading fibers 304 may cause some current to flow through the other series of loops, loops 362*a–c*, e.g., with loops 362*c* generally passing more current than loops 362*b*, and loops 362*b* generally passing more current than loops 362*a*. The weave arrangement of switch 600 offers a high level of redundancy (e.g., if one loading fiber 304 breaks, the three remaining loading fibers 304 can still maintain sufficient normal contact forces at the contact points) and separates the steady-state current carrying loops, loops 362*d*, from the transient arcing loops, loops 362*a*.

Recognizing that certain loops may be subjected to different operational conditions, e.g., the transient loops 362*a* are subjected to arcing while the steady-state loops 362*d* are not, in certain embodiments different conductive platings and/or materials can be used to form the different loops 362*a–d*, different contact mating surfaces 632, or both. Gold, for example, is soft and may be easily damaged by arcing (depending on the arc energy), while silver is less subject to such arc-induced degradation and damage. Thus, to extend the design life of the switch 600, in certain embodiments, the transient loops 362*a* are plated with silver, while in other alternative embodiments, the transient loops 362*a* are made entirely from silver, i.e., those portions of the conductors 302 that form the loops 362*a* are comprised of silver. In such embodiments, the remaining loops 362*b–d* (i.e., the conductive portions thereof) can be plated with gold or tin, or other such materials, since these portions of the weave will not be subjected to arcing. Therefore, the properties of the conductive loops 362*a–d* of the conductor 302-loading fiber 304 weave can be optimized for current-carrying capacity in the same way as a power connector.

To make transient loops 362*a* more resistant to arc-induced damage, in other exemplary embodiments, loops 362*a* are plated with a sufficiently high thickness of gold while the rest of the loops 362*b–d*, since they are not subjected to arcing, are plated with a thinner layer of gold. By tailoring the plating thickness of the loops 362*a–d* (or the thickness of the appropriate portions of conductors 302 that form the various loops 362*a–d*) to better match the operational conditions of the separate loops, significant material cost and manufacturing cost savings can be realized.

In other alternate exemplary embodiments, the entire contact mating surface 632 area and/or the conductors 302 of the weave(s) are comprised of silver.

Figure 35:
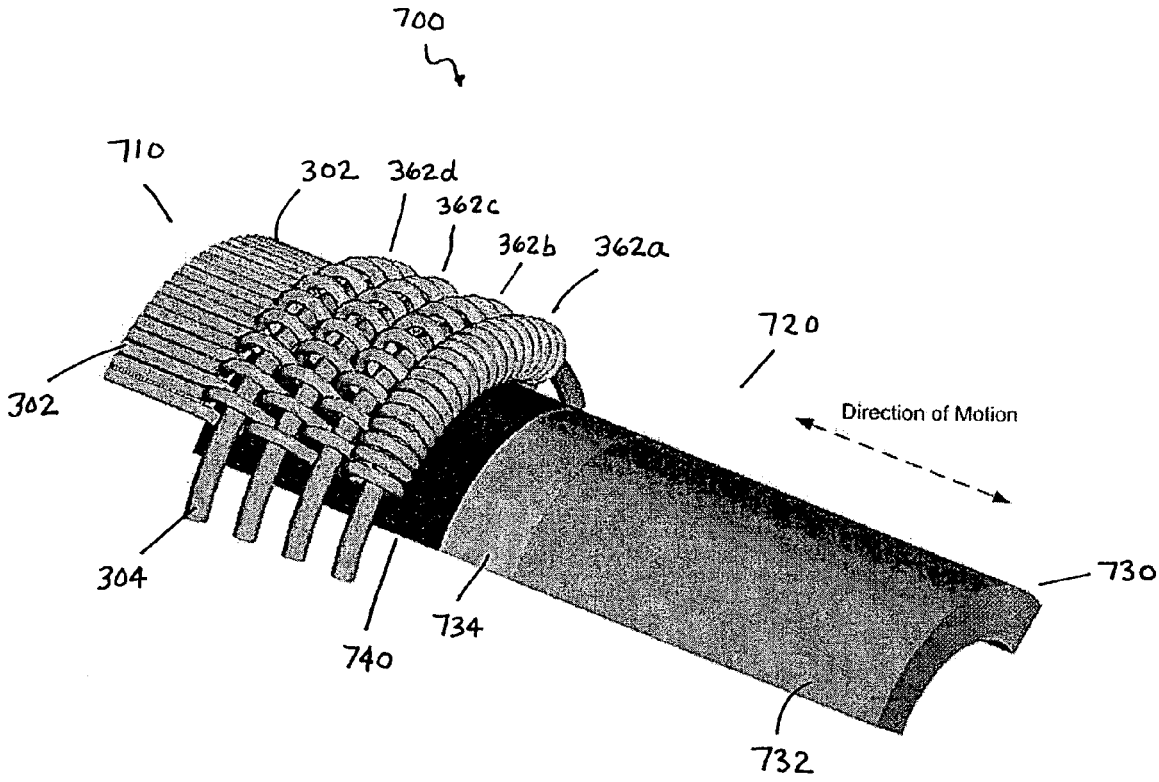
FIG. 35 depicts another exemplary embodiment of a woven multi-contact switch in accordance with the teachings of the present disclosure.

A partial view of an exemplary multi-contact woven electrical switch embodiment is shown in FIG. 35. The switch 700 of FIG. 35 consists of a woven switch element 710 and a mating switch element 720. The woven switch element 710, which is similar to the woven switch element 610 of switch 600, has several conductors 302 woven onto four loading fibers 304 to form four series of loops 362*a–d*. The transient loops 362*a*, i.e., the loops that are subjected to arcing, are plated with a conductive, arc-resistant material such as silver, for example. The conductive, arc-resistant material that is disposed on the transient loops 362*a* serves to protect the underlying conductive material (e.g., copper) from arc erosion, damage or degradation.

Unlike the mating conductor switch element 620, mating switch element 720 of switch 700 consists of a mating conductor 730 and a mating non-conducting portion 740 which is located at the distal end of the mating switch element 720. The mating non-conducting portion 740, which is comprised of (or is plated with) a non-conducting material, provides a non-conducting surface that the conductor 302-loading fiber 304 weave of the woven switch element 710 can slide over when it is engaging (or disengaging) the mating conductor 730. In other words, the non-conducting portion 740 of the mating switch element 720 serves as a guide support for the conductor 302-loading fiber 304 weave of the of the woven switch element 710.

The mating conductor 730 has a contact mating surface 732. The portion of the contact mating surface 732 that is disposed adjacent to the non-conducting portion 740 is coated with a conductive, arc-resistant material 734. In other words, the conductive, arc-resistant material 734 is located on the contact mating surface 732 where arcing between the transient loops 362*a* and the mating conductor 730 is expected to occur. The conductive, arc-resistant material 734, thus, serves to protect the contact mating surface 732 from arc erosion, damage or degradation.

When the switch 700 is in the open position, as depicted in FIG. 35, the contact points of conductors 302 contact with the mating non-conducting portion 740 of the mating switch element 720 and, thus, current does not flow between the woven switch element 710 and the mating switch element 720. When moved into the closed position, the contact points of the conductors 302 come into contact with the mating conductor 730 of the mating switch element 720. An advantage of this approach is that vibrations and tolerance issues that can cause the woven switch element 710 and mating switch element 720 to become misaligned can be greatly reduced. Without the mating non-conductive portion 740 being present, if the woven switch element 710 is misaligned when the engagement is initiated, portions of the conductor 302-loading fiber 304 weave might get damaged when the woven switch element 710 is engaged with the mating switch element 720. Thus, in switch 700, the conductor 302-loading fiber 304 weave is always maintained against a surface, either a conducting or non-conducting surface. The non-conducting portion 740 of the mating switch element 720 can be comprised of a low friction material (e.g. Teflon) that aids the sliding action and reduces wear.

The components of the switch 700 of FIG. 35 can be mounted in a housing(s) (not shown). The housing could include access ports for power connections and an actuator for engaging/disengaging the switch 700. The termination contacts of the conductors 302 and the mating conductor 730 can be connected, via wires, cables, busbars, PWB, etc., to either end of a voltage source. The switch 700 could make temporary contact by attaching a spring to one end opposing the actuation mechanism so that when the actuator is released the spring pushes the surface back to its initial position. The switch 700 could alternately act like a snap acting switch, i.e., when the actuator is pressed the contact mating surface 732 of the mating conductor 730 'snaps' into place using a cantilevered arm.

In an alternate embodiment, the conductive, arc-resistant material 834 may be disposed over a part of the non-conducting portion 740 that is adjacent to the mating conductor 730.

Figure 36:
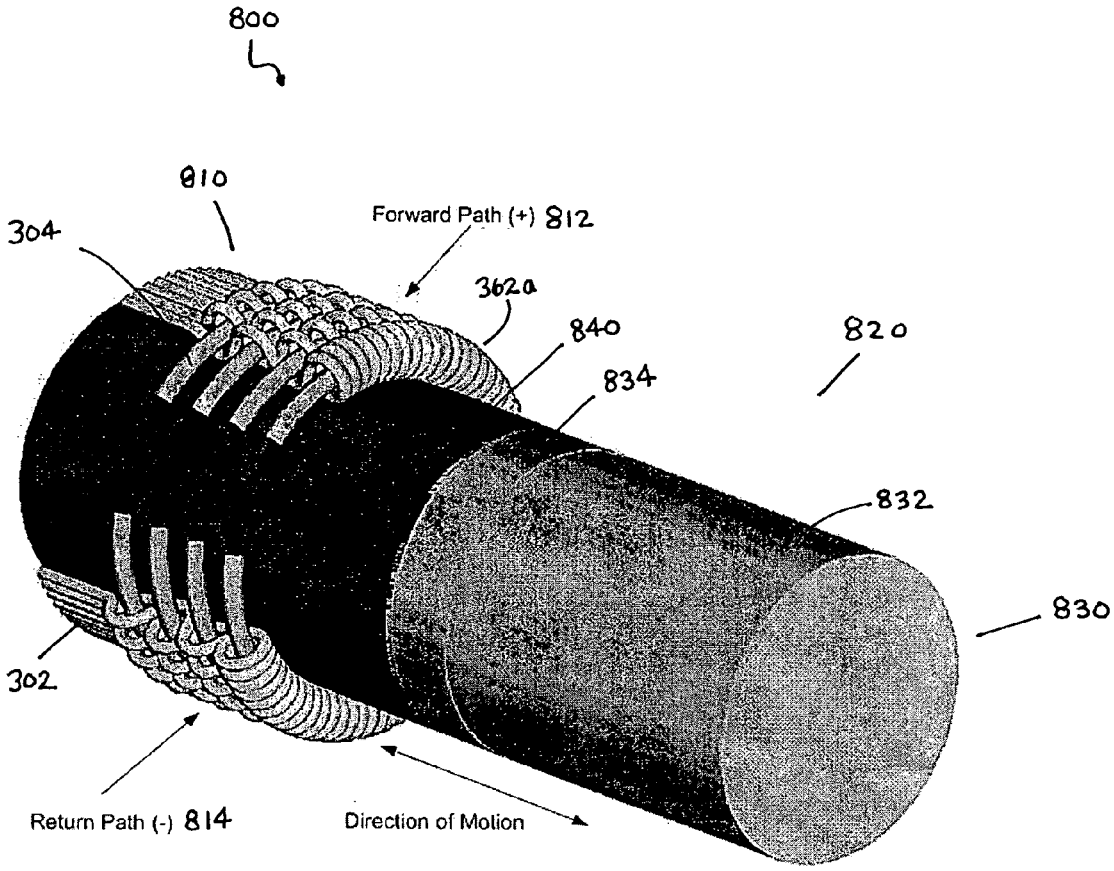
FIG. 36 depicts yet another exemplary embodiment of a woven multi-contact switch in accordance with the teachings of the present disclosure.

FIG. 36 illustrates another exemplary embodiment of a multi-contact woven electrical switch. Switch 800 of FIG. 36 has a woven switch element 810 and a mating switch element 820. The woven switch element 810 consists of two sets of conductors 302, each of which is woven onto the same four loading fibers 304. The first set of woven conductors 302 forms a forward electrical path 812 (e.g., a power circuit) and the second set of woven conductors 302 forms a return electrical path 814 (e.g., a return circuit) which is separated from the forward path 812. As previously discussed, non-conducting fibers can be woven onto the loading fibers 304 between the forward and return paths 812, 814 to prevent accidental shorting between the two paths 812, 814. Mating switch element 820, which is similar to mating switch element 720, includes a mating non-conducting portion 840 and a mating conductor 830. The non-conducting portion 840, which is comprised of (or is plated with) a non-conducting material, provides a non-conducting surface that the forward path 812 and return path 814 can slide over when engaging (or disengaging) the mating conductor 830. The mating conductor 830 has a contact mating surface 832. Similarly to switch 700, the portion of the contact mating surface 832 that is disposed adjacent to the non-conducting portion 840 is coated with a conductive, arc-resistant material 834. As the mating conductor 830 of the mating switch element 820 engages the forward and return paths 812, 814, respectively, the switch 800 becomes closed and current can thus flow, i.e., current is allowed to flow down through the conductors 302 of the forward path 812, across the mating conductor 830 of the mating switch element 820 and up through the conductors 302 of the return path 814.

One advantage of the switch 800 is that the conductive, arc-resistant material 834 can be a simple sleeve that fits around the mating conductor 830 (or the non-conducting portion 840). Another advantage is that the mating switch element 820 can be made to be hollow, which may provide easier alignment with the woven switch element 810. These advantages can result in a mating switch element 820 that is easier and less costly to produce. The design of the switch 800 can likewise be incorporated into temporary pushbutton types or permanent snap-acting or toggle switches.

Figure 37:
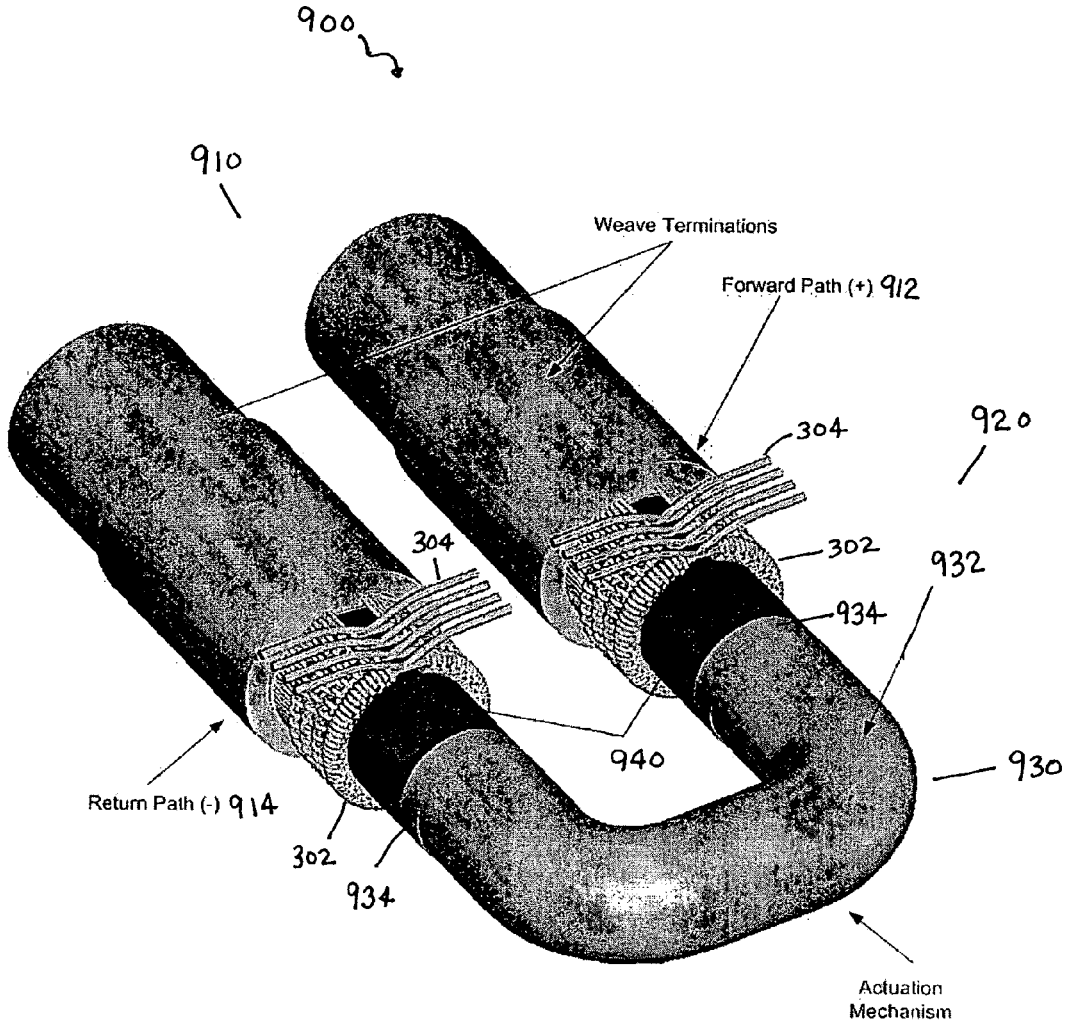
FIG. 37 depicts another exemplary embodiment of a woven multi-contact switch in accordance with the teachings of the present disclosure.

An alternate embodiment of a woven multi-contact switch is shown in FIG. 37. Here, as opposed to the switch 800 of FIG. 36, both the forward and return paths are separate connector bodies. Switch 900 of FIG. 37 includes a woven switch element 910 and a U-shaped mating switch element 920. The woven switch element 910 consists of two sets of conductors 302 that, unlike switch 800, are each woven onto a different set of loading fibers 304. The first set of woven conductors 302 forms a forward electrical path 912 (e.g., a power circuit) and the second set of woven conductors 302 forms a return electrical path 914 (e.g., a return circuit). The ends of the conductors 302 of the forward path 912 terminate into a termination contact while the ends of the conductors 302 of the return path 914 terminate into a separate termination contact. The ends of the loading fibers 304 can be coupled to spring mounts, as previously discussed.

The U-shaped mating switch element 920 has mating non-conducting portions 940 that are disposed at each end of the U-shaped mating switch element 920 and a mating conductor 930 that is disposed between the two mating non-conducting portions 940. The non-conducting portions 940, which are comprised of (or plated with) a non-conducting material, provide non-conducting surfaces that the forward path 912 and return path 914 can slide over to engage (or disengage) the mating conductor 930. The mating conductor 930 has a contact mating surface 932. The two portions of the contact mating surface 932 that lie adjacent to the two non-conducting portions 940 are coated with a conductive, arc-resistant material 934. As the mating conductor 930 of the mating switch element 920 engages the forward and return paths 912, 914, respectively, the switch 900 closes and current can thus flow, i.e., current is allowed to flow down through the conductors 302 of the forward path 912, along the length of the (U-shaped) mating conductor 930 of the mating switch element 920 and up through the conductors 302 of the return path 914. The termination contacts of the forward and return paths 912, 914 can be terminated to the same circuit board or be connected to terminal blocks for cable termination. Using separate conductive weaves to form separate forward and return paths allows switch 900 to be quite compact.

Figure 38:
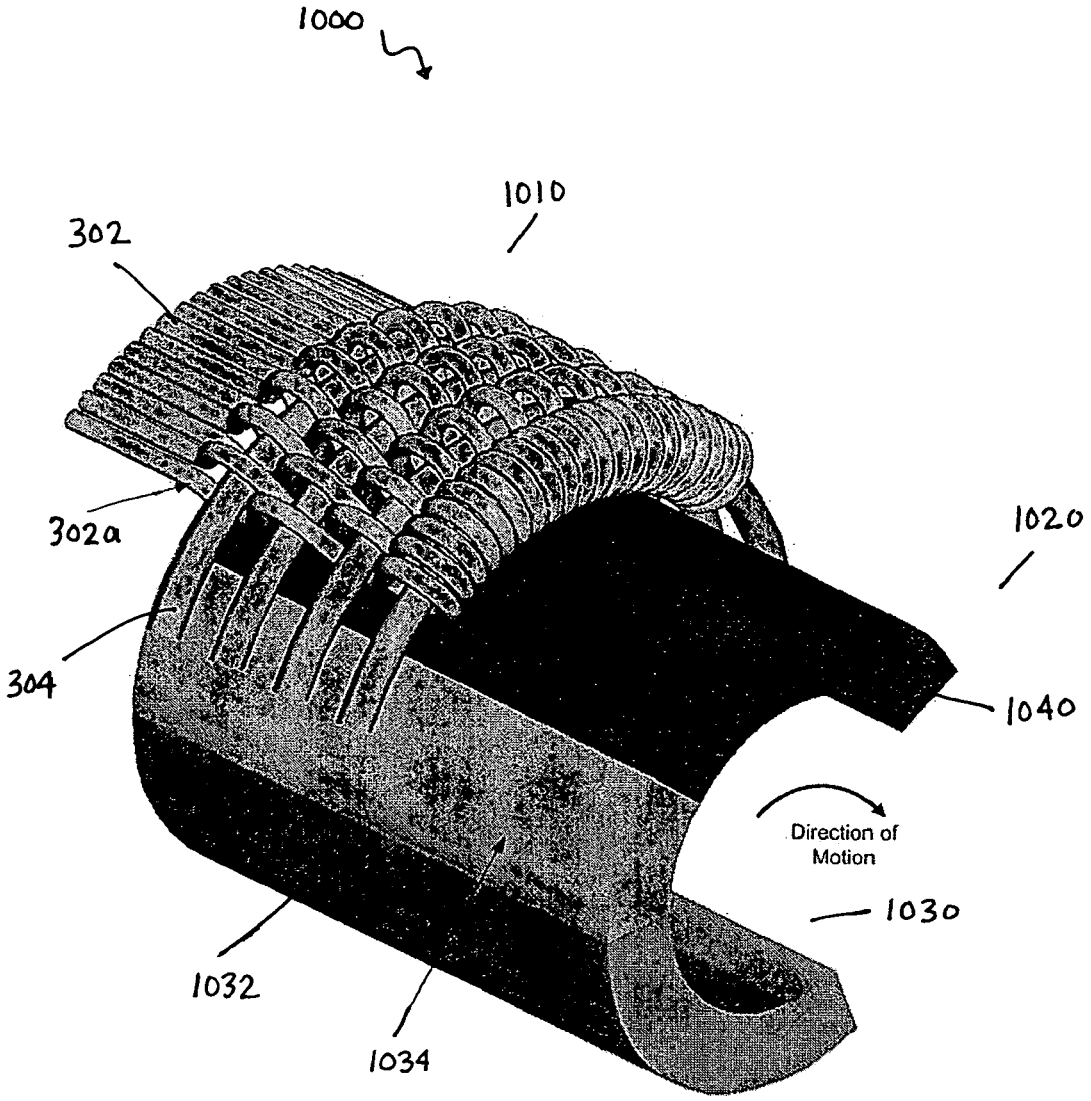
FIG. 38 depicts a further exemplary embodiment of a woven multi-contact switch in accordance with the teachings of the present disclosure.

Another embodiment of an exemplary woven multi-contact switch involves a rotary design as shown in FIG. 38. Switch 1000 of FIG. 38 consists of a woven switch element 1010 and a mating switch element 1020. The woven switch element 1010 consists of several conductors 302 that are woven onto four loading fibers 304 to form four series of loops 362*a–d*. The mating switch element 1020, which is generally arranged as a tube having a longitudinally-disposed hollow center, has a mating conductor portion 1030 and a mating non-conducting portion 1040. As can be seen in FIG. 38, the mating conductor portion 1030 and the non-conducting portion 1040 both extend along the longitudinal length of the mating switch element 1020 but occupy different radial portions of the mating switch element 1020. The mating conductor portion 1030 has a contact mating surface 1032. The area of the contact mating surface 1032 that abuts the non-conducting portion 1040 (along the longitudinal length of the mating switch element 1020) is coated with a conductive, arc-resistant material 1034. Unlike the multi-contact switch embodiments that are discussed above, a rotary motion (as indicated in FIG. 38) is used to facilitate the opening and closing of switch 1000. FIG. 38 shows the switch 1000 in its open, disengaged position. To engage switch 1000, mating switch element 1020 is rotated clockwise (while holding woven switch element 1010 stationary) or, alternatively, woven switch element 1010 is rotated counter-clockwise (while holding mating switch element 1020 stationary).

Because of the nature of the rotary motion, the first series (or row) of loops 362*a* is not the first to engage the mating conductor portion 1030 of the mating switch element 1020. Instead, a portion of each row of loops 362*a–d* engages the mating conductor at the same time. More specifically, the "innermost" conductor 302-labeled as conductor 302*a* in FIG. 38—of the weave comes into contact with mating conductor portion 1030 (e.g., the conductive, arc-resistant material 1034) before the other conductors 302. This can lead to certain advantages as the innermost conductor 302*a* can be made from an arc-resistant material such as silver, for example. Having an entire single conductor made from silver (or other appropriate material) is easier than coating a single row of loops (comprising portions of several conductors) of the weave. However, a disadvantage of this embodiment can be that the entire current then has to flow through the one conductor 302*a* until the rotary mechanism causes each of the other conductors 302 to engage with the mating conductor portion 1030. The conductors 302 comprising the weave would thus be temporarily unbalanced from a current point of view. This may not be a problem in all applications, such as low current applications, however. To overcome this disadvantage, in an alternate embodiment, the outer surface of the mating switch element 1020 is subdivided into rows and columns of alternating conductive and non-conductive sections so that more than one conductor 302 of the weave engages a conductive section of the mating switch element 1020 at the same time. In other words, the outer contact surface of the mating conductor portion 1030 can have a checkerboard arrangement of alternating conductive and non-conducting "squares" such that a relatively small rotation of the mating switch element 1020 causes a plurality of the contact points of the conductors 302 to come into (or out of) contact with the conductive portions of the mating switch element 1020 at the same time.

The electrical switch embodiments described above all utilize "wiping" actions. A wiping action can be beneficial because it can help clean the surfaces of micro-contaminants. There are numerous other woven switch embodiments, however, that do not utilize a wiping action. The conductor-loading fiber weave technology described herein can also be used in those situations that demand butt contacts, where the two surfaces simply butt together and there is no wiping action between the contacts.

Referring back to the embodiment shown in FIGS. 34*a–c*, if the motion of the mating switch element 620 is up and down, instead of left to right, the embodiment depicted in FIGS. 34*a–c* would be a butt contact. In that case, the loading fibers 304 could be optimized or tuned to a tensional load that produces the least amount of bounce. This could reduce surface welding and thus reduce the amount of force that may be required to pull the contacts apart if welding does occur. This, moreover, in turn, could lead to a decreased normal force that is required to engage the contacts and, therefore, less bounce.

Membrane or metal dome switches are very small switches used in a variety of electronic devices including cell phones, calculators and keypads. There is typically no wiping action involved with these particular switches. Another embodiment of the conductor 302-loading fiber 304 weave concept can also be used to produce very small switches that utilize butt contacts. This embodiment consists of a grid support structure that has a circuit pitch of similar size to the switch actuator (e.g., membrane or metal dome depression members) where loading fibers are run across a grid support structure and conductors are wrapped around each loading fiber at each desired contact point. The loading fibers can be tensioned using an external mechanism (extension spring, cantilevered arm, etc.) and when the actuator (metal dome or equivalent) is pressed it makes contact with the weave. The downward deflection of the contact and the tension in the loading fibers produces a net normal force at the contact point. The grid support structure can thus provide local support at each contact point for the loading fiber. A simple keypad on a calculator, for example, might have a 3×4 grid support structure.

Figure 39:
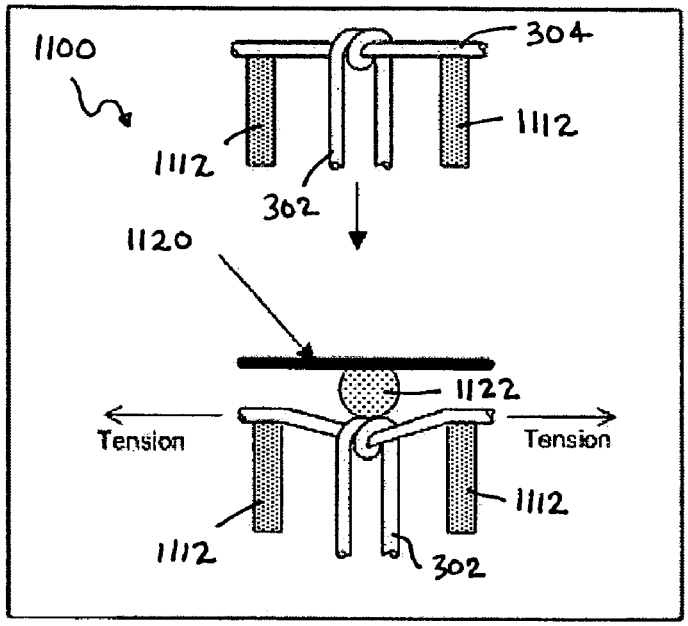
FIG. 39 depicts another exemplary embodiment of a woven multi-contact switch in accordance with the teachings of the present disclosure.

An example of a single butt contact switch 1100 is shown in FIG. 39. The switch 110 of FIG. 39 consists of conductive contact surface 1120, a conductive solder ball 1122, a loading fiber 304, a conductor 302 and two supports 1112. The conductor 302, which is disposed between the two supports 1112, is woven (e.g., looped twice) around the loading fiber 304, while the loading fiber 304 is disposed on top of and across the two supports 1112. The ends of the conductor 302 are typically soldered to (or otherwise coupled to) a second contact surface (not shown). The solder ball 1122 is coupled to the contact surface 1120 and positioned so that when the contact surface 1120 is depressed (i.e., moved towards the supports 1112), the solder ball 1122 comes into contact with the contact points of the conductor 302. The downward deflection of the contact surface 1120 and the solder ball 1122 causes a portion of the loading fiber 304 that is disposed between the two supports 1112 to become deflected downward, while the portions of the loading fiber 304 that are disposed above the supports 1112 generally remain stationary. As previously discussed, the downward deflection assists in generating the tension T within the loading fiber 304. The loading fiber 304 may be preloaded and pre-tensioned using an external spring mount, for example. If the loading fiber 304 is elastic, then the tensile load T comes from deflecting the fiber downward and effectively changing the length of the loading fiber 304 between the supports 1112. If the loading fiber 304 is inelastic, then the change in length of the fiber 304 due to the downward deflection causes at least one end of the fiber to be pulled in towards the contact point. If this end is attached to an end of a spring, then the tension T is induced in the loading fiber 304. Thus, as previously discussed, the normal contact force produced at the contact points is dependent on the tension T in the loading fiber and the angle induced between the loading fiber 304 and the contact point(s). Therefore, the further downward the contact point is push with respect to the supports 1112, the higher the normal contact force.

The contact surface 1120 of switch 1100 can define a return path where the second contact surface (not shown) defines a forward path. The amount of current that can flow through the switch 1100 is generally small because all of the current has to flow through a single conductor 302. Since the current passing through the contact interface is relatively small, arcing therefore is generally not an issue with the switch 1100. For devices such as cell phones and calculators, the amount of current that flows is negligible. The switch 1100 is primarily used to accommodate an electrical signal, such as a data signal, for example. Since contact bouncing can cause multiple triggers on an electrical circuit, contact bouncing can be an issue, however, even when arcing issues are not present. One way to avoid contact bouncing issues is to utilize a dead time whereby a circuit will not register a change in state in a circuit until a fixed amount of time after a contact is initially sensed. This can help prevent the system from registering multiple on/off cycles for a single make or break sequence. This dead time, however, can cause the processing time or operational frequency of a system to be higher in comparison to systems that do not to correct for contact bounce issues. However, by changing the tension T and dynamics of the switch 1100, it is possible to eliminate or reduce the bounce dead time.

Figure 40:
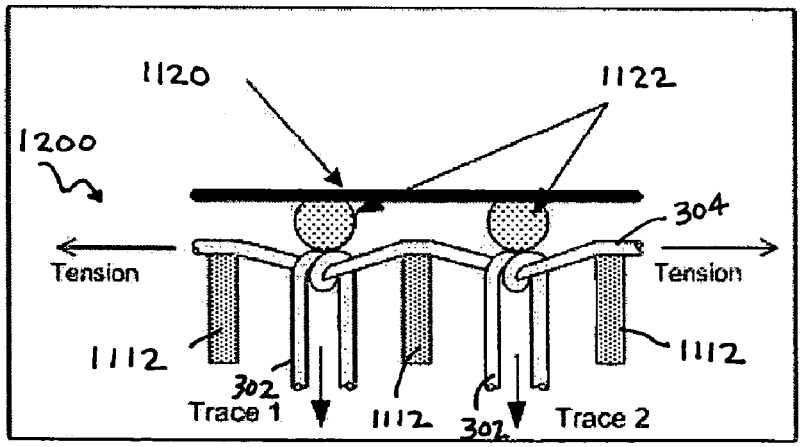
FIG. 40 depicts yet another exemplary embodiment of a woven multi-contact switch in accordance with the teachings of the present disclosure.

An alternative embodiment that can be used for switching between two small signal traces on a circuit board is shown in FIG. 40. Switch 1200 of FIG. 40 utilizes a grid support structure having three supports 1112. A conductor 302 is disposed between the first and second supports 1112 while a second conductor 302 is disposed between the second and third supports 1112. The first conductor 302 defines a first electrical trace and the second conductor 302 defines a second electrical trace. The second electrical trace is electrically isolated from the first electrical trace. The two conductors 302 are woven onto the same loading fiber 304. If the cross-sectional area of the conductor 302 is small (for example, 0.002"), then the circuit pitch would be very small (for example under 0.005"), thus allowing very high board densities to be achieved. These embodiments of butt contact switches are potentially more rugged than present membrane and metal dome switches.

While the embodiments described above only discuss loading fibers 304 arranged in a single direction that runs orthogonally to the conductors 302, in some alternative embodiments the loading fibers are arranged as an orthogonal array (i.e., running in two directions) with conductors 302 woven at an angle to the loading fibers 304, e.g., running along a 45 degree angle. This can provide an additional layer of contact redundancy since both loading fibers corresponding to a given contact point of a conductor would have to fail in order to lose contact force at the contact point. The embodiments also provide a more accurate location of the contact point.

In some of the butt contact switch embodiments, the loading fibers are comprised of a non-conducting material. In other embodiments, the loading fibers are comprised of a conductive material. When a conductive material is used, however, the loading fibers should be designed so as not to cause the switch to short-circuit. Using conductive loading fibers can facilitate load balancing.

In conventional switches, the interface resistance can become prohibitively higher due to the presence of contaminants within the switch. To avoid particle contamination, many conventional switches today are assembled within a sealed housing and care is taken at the manufacturing level to ensure that particles do not become entrapped. These procedures may add additional costs to the manufacturing process. Because of the compliant nature of the woven switch technology, and the highly redundant multiple points of contact, the switches of the present disclosure may not need to utilize a sealed housing.

Another potential application for this technology is for over-current protection, i.e., circuit breakers. A circuit breaker is simply a switch that opens a circuit if a fault is detected. There are two broad categories of circuit breakers: magnetic circuit breakers and thermal circuit breakers. Magnetic circuit breakers tend to be fast acting but not rugged. Thermal circuit breakers tend to be rugged but slow acting. There are combinations of the two that are available. Since each weave responds quickly to changes in current as a result of its small thermal mass, the woven switch technology can be used in a fast (or at least faster) acting circuit breaker. The parameters that define a circuit breaker are very similar to those for switches and connectors, e.g., contact resistance, wear, arc-handling capability, etc. The inherent advantages of the woven switch technology described herein can be used to make circuit breakers that are small, yet rugged.

Having thus described various illustrative embodiments and aspects thereof, modifications and alterations may be apparent to those of skill in the art. Such modifications and alterations are intended to be included in this disclosure, which is for the purpose of illustration only, and is not intended to be limiting. The scope of the invention should be determined from proper construction of the appended claims, and their equivalents.

The invention claimed is:

1. A multi-contact woven electrical switch, comprising:

at least one loading fiber;

at least one conductor, each conductor having at least one contact point and each conductor being woven with at least one loading fiber, wherein said at least one loading fiber is capable of delivering a contact force at each contact point of each conductor; and a mating conductor having a contact mating surface, wherein an electrical connection can be established between said at least one contact point of at least one conductor and said contact mating surface of said mating conductor when said switch is in a closed position.

2. The multi-contact woven electrical switch of claim 1, wherein said at least one loading fiber is comprised of a non-conducting material.

3. The multi-contact woven electrical switch of claim 1, wherein said at least one loading fiber is comprised of a conducting material.

4. The multi-contact woven electrical switch of claim 1, wherein said at least one conductor is self-terminating.

5. The multi-contact woven electrical switch of claim 1, further comprising:

a spring mount having attachment points;

wherein each of said at least one loading fiber has a first end and a second end; and wherein said first end of at least one loading fiber is coupled to an attachment point of said spring mount.

6. The multi-contact woven electrical switch of claim 1, further comprising:

first and second spring mounts;

each loading fiber having a first end and a second end; and wherein said first end of at least one loading fiber is coupled to said first spring mount and wherein said second end of at least one loading fiber is coupled to said second spring mount.

7. The multi-contact woven electrical switch of claim 1, further comprising:

first and second loading fibers, each loading fiber having two ends;

first and second spring mounts; and said ends of said first loading fiber being coupled to said first spring mount and said ends of said second loading fiber being coupled to said second spring mount.

8. The multi-contact woven electrical switch of claim 1, wherein at least a portion of said contact mating surface is curved.

9. The multi-contact woven electrical switch of claim 8, wherein said curved portion of said contact mating surface is convex.

10. The multi-contact woven electrical switch of claim 1, wherein said mating conductor is substantially rod-shaped.

11. The multi-contact woven electrical switch of claim 1, wherein at least a portion of said contact mating surface of said mating conductor is comprised of a conductive arc-tolerant material.

12. The multi-contact woven electrical switch of claim 11, wherein said conductive arc-tolerant material comprises silver or a silver-plated material.

13. The multi-contact woven electrical switch of claim 1, wherein at least a portion of said contact mating surface of said mating conductor is comprised of a non-conductive material.

14. The multi-contact woven electrical switch of claim 13, wherein said at least one contact point of each conductor engages at least a portion of said non-conductive material when said switch is in an open position.

15. The multi-contact woven electrical switch of claim 13, wherein at least another portion of said contact mating surface of said mating conductor is comprised of a conductive arc-tolerant material, said conductive arc-tolerant material being disposed adjacent to said non-conductive material.

16. The multi-contact woven electrical switch of claim 13, wherein said non-conductive portion of said contact mating surface serves as a support guide that at least partially supports said at least one conductor and said at least one loading fiber when said switch is in an open position.

17. The multi-contact woven electrical switch of claim 1, further comprising an actuator capable of placing said switch in said closed position.

18. The multi-contact woven switch of claim 1, wherein a conductor is woven to form a plurality of loops each having a contact point, and wherein at least the portion of said conductor that forms a contact point of a first loop is comprised of a conductive arc-tolerant material.

19. The multi-contact woven switch of claim 1, wherein a conductor is woven to form a plurality of loops each having a contact point, and wherein at least the portion of said conductor that forms a contact point of a first loop is plated with a conductive arc-tolerant material.

20. The multi-contact woven switch of claim 1, wherein at least one conductor is comprised of a conductive arc-tolerant material.

21. The multi-contact woven switch of claim 20, wherein said conductor comprised of said conductive arc-tolerant material is the first conductor to contact said contact mating surface when said switch is moved from an open position to said closed position.

22. The multi-contact woven switch of claim 1, wherein each conductor has at least a first cross-sectional area and a second cross-sectional area, said first cross-sectional area being greater than said second cross-sectional area, said first cross-sectional areas of said conductors located where arcing between said conductors and said contact mating surface occurs.

23. The multi-contact woven switch of claim 1, wherein said switch is a butt contact type switch.

24. The multi-contact woven switch of claim 1, wherein said switch is a circuit breaker.

25. The multi-contact woven switch of claim 1, further comprising first and second tensioning guides, wherein a conductor is disposed between said first and second tensioning guides and woven onto a loading fiber, and wherein portions of said loading fiber contact said first and second tensioning guides when said switch is in said closed position.

26. The multi-contact woven switch of claim 25, wherein said first and second tensioning guides are comprised of support columns.

27. The multi-contact woven switch of claim 25, wherein said mating conductor comprises a substantially planar contact surface and at least one solder ball.

28. The multi-contact woven switch of claim 1, wherein a plurality of loading fibers form a grid having a plurality of intersections and wherein at least one conductor is coupled to at least one loading fiber at or near an intersection of said grid.

29. The multi-contact woven switch of claim 1, wherein an electrical connection can not be established between said at least one contact point of at least one conductor and said contact mating surface of said mating conductor when said switch is in an open position.

30. A multi-contact woven electrical switch, comprising:

a plurality of loading fibers;

a plurality of conductors, each conductor having at least one contact point and being woven with at least one loading fiber, said loading fibers being capable of delivering a contact force at each contact point of each conductor; and a mating conductor having a contact mating surface, wherein an electrical connection can be established between said at least one contact point of said plurality of conductors and said contact mating surface of said mating conductor when said switch is in a closed position.

31. The multi-contact woven electrical switch of claim 30, wherein said mating conductor is substantially rod-shaped.

32. The multi-contact woven electrical switch of claim 31, wherein said contact mating surface of said mating conductor comprises a non-conductive portion and a conductive portion, and wherein said at least one contact point of each conductor engages at least a portion of said non-conductive portion when said switch is in an open position and wherein at least one contact point of at least one conductor engages at least a portion of said conductive portion when said switch is in a closed position.

33. The multi-contact woven electrical switch of claim 32, wherein said non-conductive portion of said contact mating surface is radially disposed at one end of said mating conductor and said conductive portion of said contact mating surface is radially disposed adjacent to said non-conductive portion.

34. The multi-contact woven electrical switch of claim 33, wherein a conductive arc-resistant material is disposed over a section of said conductive portion adjacent to said non-conductive portion.

35. The multi-contact woven electrical switch of claim 33, wherein a conductive arc-resistant material is disposed over a section of said non-conductive portion adjacent to said conductive portion.

36. The multi-contact woven electrical switch of claim 32, wherein said non-conductive portion of said contact mating surface is disposed along the length of said mating conductor and said conductive portion of said contact mating surface is disposed along the length of said mating conductor adjacent to said non-conductive portion.

37. The multi-contact woven electrical switch of claim 36, wherein a conductive arc-resistant material is disposed over a section of said conductive portion adjacent to said non-conductive portion.

38. The multi-contact woven electrical switch of claim 36, wherein a conductive arc-resistant material is disposed over a section of said non-conductive portion adjacent to said conductive portion.

39. The multi-contact woven electrical switch of claim 31, wherein said contact mating surface of said mating conductor comprises a plurality of non-conductive sections and a plurality of conductive sections, and wherein said at least one contact point of each conductor engages at least a portion of said non-conductive sections when said switch is in an open position and wherein at least one contact point of at least one conductor engages at least a portion of said conductive sections when said switch is in a closed position.

40. The multi-contact woven electrical switch of claim 30, wherein said plurality of conductors includes a first set of conductors and a second set of conductors, said first and second sets of conductors being woven with said plurality of loading fibers, and wherein said first set of conductors defines a first electrical path and said second set of conductors defines a second electrical path that is electrically isolated from said first electrical path.

41. The multi-contact woven electrical switch of claim 30, wherein said plurality of conductors includes a first set of conductors and a second set of conductors and said plurality of loading fibers includes a first set of loading fibers and a second set of loading fibers, said first set of conductors being woven with said first set of loading fibers and said second set of conductors being woven with said second set of loading fibers, and wherein said first set of conductors defines a first electrical path and said second set of conductors defines a second electrical path that is electrically isolated from said first electrical path.

42. A multi-contact woven electrical switch, comprising:

at least one loading fiber;

at least one conductor, each conductor having at least one contact point and each conductor being woven with at least one loading fiber to form a weave, wherein said at least one loading fiber is capable of delivering a contact force at each contact point of each conductor; and a mating conductor having a contact mating surface, wherein an electrical connection can be established between said at least one contact point of at least one conductor and said contact mating surface of said mating conductor when said switch is in a closed position, and wherein said mating conductor is physically independent of said weave.

43. The multi-contact woven electrical switch of claim 42, wherein said mating conductor is substantially rod-shaped.

44. The multi-contact woven electrical switch of claim 42, wherein at least a portion of said contact mating surface of said mating conductor is comprised of a non-conductive material, and wherein said at least one contact point of each conductor engages at least a portion of said non-conductive material when said switch is in an open position.

45. The multi-contact woven electrical switch of claim 42, wherein at least a portion of said contact mating surface of said mating conductor is comprised of a non-conductive material, and wherein at least another portion of said contact mating surface of said mating conductor is comprised of a conductive arc-tolerant material, said conductive arc-tolerant material being disposed adjacent to said non-conductive material.

46. The multi-contact woven electrical switch of claim 42, wherein at least a portion of said contact mating surface of said mating conductor is comprised of a non-conductive material, and wherein said non-conductive portion of said contact mating surface serves as a support guide that at least partially supports said at least one conductor and said at least one loading fiber when said switch is in an open position.

47. The multi-contact woven switch of claim 42, wherein a conductor is woven to form a plurality of loops each having a contact point, and wherein at least the portion of said conductor that forms a contact point of a first loop is comprised of a conductive arc-tolerant material.

48. The multi-contact woven switch of claim 42, wherein at least one conductor is comprised of a conductive arc-tolerant material, and wherein said conductor comprised of said conductive arc-tolerant material is the first conductor to contact said contact mating surface when said switch is moved from an open position to said closed position.

49. The multi-contact woven switch of claim 42, wherein each conductor has at least a first cross-sectional area and a second cross-sectional area, said first cross-sectional area being greater than said second cross-sectional area, said first cross-sectional areas of said conductors located where arcing between said conductors and said contact mating surface occurs.

50. The multi-contact woven switch of claim 42, further comprising first and second tensioning guides, wherein a conductor is disposed between said first and second tensioning guides and woven onto a loading fiber, and wherein portions of said loading fiber contact said first and second tensioning guides when said switch is in said closed position.

51. The multi-contact woven switch of claim 50, wherein said first and second tensioning guides are comprised of support columns.

52. The multi-contact woven switch of claim 50, wherein said mating conductor comprises a substantially planar contact surface and at least one solder ball.

53. The multi-contact woven switch of claim 42, wherein a plurality of loading fibers form a grid having a plurality of intersections and wherein at least one conductor is coupled to at least one loading fiber at or near an intersection of said grid.

* * * * *